US012612555B2

(12) United States Patent
Ritchey et al.

(10) Patent No.: US 12,612,555 B2
(45) Date of Patent: Apr. 28, 2026

(54) SYSTEMS AND METHODS FOR REMOVING CARBON FROM REACTION CHAMBERS IN PYROLYSIS REACTORS

(71) Applicant: Modern Hydrogen, Inc., Woodinville, WA (US)

(72) Inventors: Andrew James Ritchey, Bothell, WA (US); Scott Edward Hogan, Mukilteo, WA (US); Stephen I. Harris, Long Beach, CA (US); Mahdi Mahdi, Shoreline, WA (US); Max Nathan Mankin, Shoreline, WA (US)

(73) Assignee: Modern Hydrogen, Woodinville, WA (US)

( * ) Notice: Subject to any disclaimer, the term of this patent is extended or adjusted under 35 U.S.C. 154(b) by 0 days.

(21) Appl. No.: 18/925,643

(22) Filed: Oct. 24, 2024

(65) Prior Publication Data

US 2025/0129289 A1 Apr. 24, 2025

Related U.S. Application Data

(60) Provisional application No. 63/592,909, filed on Oct. 24, 2023.

(51) Int. Cl.
*C10B 43/04* (2006.01)
*C10B 53/02* (2006.01)

(52) U.S. Cl.
CPC ..... *C10B 43/04* (2013.01); *C10B 53/02* (2013.01)

(58) Field of Classification Search
CPC ..... B01J 19/0026; B01J 19/0053–0073; B01J 19/1812–1843; B01J 19/185; B01D 1/06–12; B01D 1/222–228
See application file for complete search history.

(56) References Cited

U.S. PATENT DOCUMENTS 3,067,812 A * 12/1962 Latinen ..... B01D 19/0026 210/179
3,480,514 A * 11/1969 Kinzler ..... C10B 43/06 202/256
5,768,894 A * 6/1998 Li ..... B01D 1/222 165/DIG. 84
9,096,801 B2 * 8/2015 Baker ..... C10G 11/05
9,212,058 B2 12/2015 De Graffenried, Sr.
10,787,362 B2 9/2020 De Graffenried, Sr.
12,297,389 B2 * 5/2025 Guymon ..... C10B 47/34
(Continued)

*Primary Examiner* — Jonathan Luke Pilcher
(74) *Attorney, Agent, or Firm* — Fredrikson & Byron, P.A.

(57) ABSTRACT

Systems and methods for removing carbon from the pyrolysis reactor are disclosed herein. For example, a pyrolysis reactor according to the present technology can include a combustion component that is fluidly couplable to a combustion fuel supply, as well as a reaction chamber that is thermally coupled to an output of the combustion component. Further, the pyrolysis reactor can include a carbon removal component that is operably coupled to the reaction chamber. The carbon removal component can include an actuator, a rod coupled to the actuator, and a scraper head coupled to the rod and positioned within the reaction chamber. The actuator can drive movement of the rod within the reaction chamber, thereby driving movement of the scraper head. The scraper head can include a plurality of teeth that are positioned to scrape carbon deposits from an interior wall of the reaction chamber.

15 Claims, 23 Drawing Sheets

(56) References Cited

U.S. PATENT DOCUMENTS

| | | | | |
|---|---|---|---|---|
| 12,312,539 | B2 * | 5/2025 | McClure | B01J 19/0066 |
| 2022/0315424 | A1 | 10/2022 | Radaelli et al. | |
| 2022/0387952 | A1 | 12/2022 | Mahdi et al. | |
| 2023/0167367 | A1 * | 6/2023 | McClure | C10B 57/06 201/2.5 |
| 2023/0227729 | A1 * | 7/2023 | Guymon | C10G 1/10 202/96 |
| 2024/0217815 | A1 | 7/2024 | Radaelli et al. | |
| 2025/0128941 | A1 | 4/2025 | Mankin et al. | |
| 2025/0128942 | A1 | 4/2025 | Mankin et al. | |
| 2025/0129936 | A1 | 4/2025 | Kumar et al. | |
| 2025/0189120 | A1 | 6/2025 | Kraemer et al. | |

* cited by examiner

SYSTEMS AND METHODS FOR REMOVING CARBON FROM REACTION CHAMBERS IN PYROLYSIS REACTORS

CROSS-REFERENCE TO RELATED APPLICATION(S)

This application claims priority to U.S. Provisional Patent Application No. 63/592,909, filed Oct. 24, 2023, the entirety of which is incorporated herein by reference.

TECHNICAL FIELD

The present technology is generally directed to systems and methods for removing solids from a reaction chamber. In particular, the present technology relates to systems and methods for removing carbon from one or more chambers of a pyrolysis reactor.

BACKGROUND

Hydrocarbon pyrolysis reactors can produce hydrogen with little or no carbon dioxide emissions. In general, pyrolysis reactors function by heating a hydrocarbon input in an oxygen-free environment to an enthalpy point (or above) for a pyrolysis reaction, then continue to add heat to encourage the reaction to fully take place. In the pyrolysis reaction, the hydrocarbon splits into various constituents, resulting in an output flow that includes solid carbon and hydrogen gas. The solid carbon can then be filtered from the output flow in a carbon collection system. As a result, pyrolysis reactors can transform the hydrocarbon input, such as methane, into combustible hydrogen while separating the carbon from the fuel. Furthermore, hydrogen gas can be used by many systems designed to use methane, natural gas, or other hydrocarbons. Thus, pyrolysis reactors create an opportunity to significantly reduce carbon dioxide, carbon monoxide, and other greenhouse gas emissions by scrubbing the carbon from methane, natural gas, or other hydrocarbons. Accordingly, hydrocarbons (e.g., natural gas) can be de-carbonized before they are combusted or reacted (e.g., to heat a home, in a furnace, in a boiler, in an engine, and the like). However, the solid carbon in the output flow sometimes collects on the walls of the pyrolysis reactor, thereby causing fouling in the reactor that eventually requires the pyrolysis reactor to be shut down for cleaning.

Figure 1:
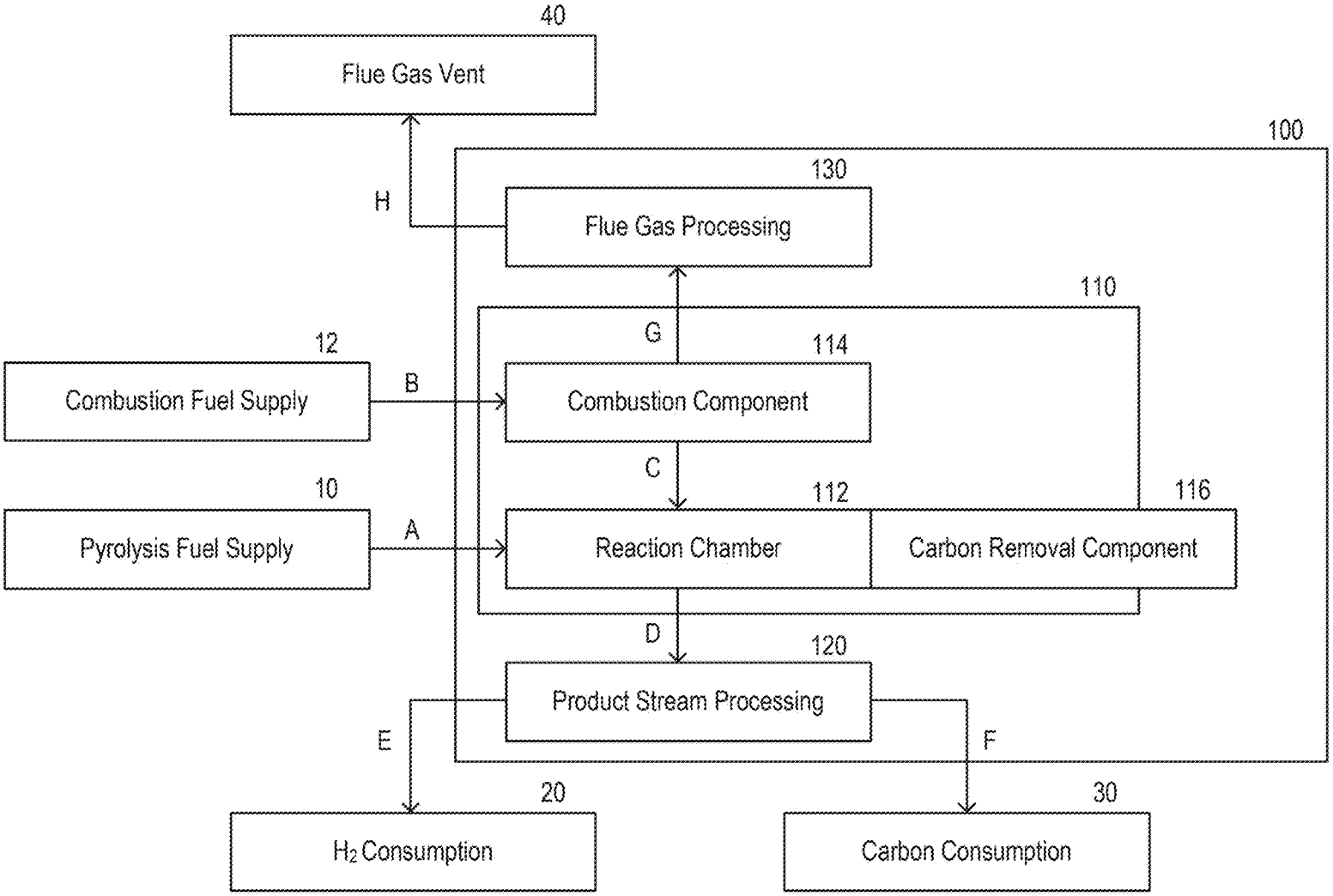
FIG. 1 is a schematic block diagram of a pyrolysis system configured in accordance with embodiments of the present technology.

The drawings have not necessarily been drawn to scale. Similarly, some components and/or operations can be separated into different blocks or combined into a single block for the purpose of discussion of some of the implementations of the present technology. Moreover, while the technology is amenable to various modifications and alternative forms, specific implementations have been shown by way of example in the drawings and are described in detail below. The intention, however, is not to limit the technology to the particular implementations described.

DETAILED DESCRIPTION

Overview

Pyrolysis reactors heat hydrocarbon reactants (e.g., methane, natural gas, ethane, propane, butane, pentane, gasoline, diesel, kerosene, and/or the like) to decompose them into hydrogen gas, solid carbon, and various products. For example, pyrolysis reactors can decompose the methane, ethane, propane, and other hydrocarbon components in natural gas to generate hydrogen gas. In the example of methane, the pyrolysis reaction is:

$$CH4(gas) \rightarrow C(solid)+2H2(gas).$$

The hydrogen gas can then be substituted as the combustion fuel anywhere the natural gas, or other hydrocarbons, would have been used. For example, the hydrogen gas can be consumed by various heating units (e.g., furnaces, water heaters, water boilers, steam boilers, and/or the like), combustion engines, fuel cells and/or power generators (e.g., in a backup power generator), combined heat and power systems, cooking units (e.g., gas stoves), and/or in various other suitable uses. Additionally, or alternatively, the hydrogen can be used in various industrial processes, such as producing various ammonia-based products (e.g., ammonia fertilizers), providing process heat, and/or other chemical processing industries and/or injected back into the natural gas pipeline to partially decarbonize the natural gas in the pipeline. Further, the solid carbon can be collected and used in various downstream applications. Purely by way of example, the solid carbon product can partially replace binders in asphalt products, thereby effectively sequestering the carbon from the hydrocarbon reactant.

The solid carbon, however, often collects on walls (and/or other surfaces) within the pyrolysis reactor. If nothing is done to remove the solid carbon buildup from the reaction chamber, it will have negative effects on the conversion of the hydrocarbon to hydrogen. Over time, the carbon buildup can eventually cause the reaction chamber to clog, thereby requiring the reaction chamber to be shut down, cleaned, and re-heated. For example, the carbon buildup (sometimes also referred to as "coke" and/or "fouling") can be removed by oxidizing the carbon with $O_2$ gas and/or air; spraying the carbon with a hot, pressurized water or steam jet; shoveling, brushing, scraping, or otherwise mechanically removing carbon. In another example, the pyrolysis reactor can incorporate a chemical vapor infiltration ("CVI") process in which a template and/or scaffold of carbon (or another material) is inserted into the reactor. The scaffold then accumulates carbon produced from pyrolysis (e.g., in addition to or in place of the walls of the reactor). The pyrolysis reactor can then be cooled to remove the scaffold, allowing the carbon to be removed and disposed of. However, these processes can produce carbon dioxide and/or carbon monoxide emissions, thereby undermining one of the goals of the pyrolysis system. Further, the cleaning results in downtime where no hydrocarbon reactant is being converted into hydrogen and solid carbon. Still further, the cool-down and reheating process can undermine the overall efficiency of the pyrolysis reaction.

In some systems, the pyrolysis reactor can be designed to aid in capturing and removing the solid carbon. For example, the pyrolysis reactor can include a fluidized bed reactor. In the fluidized bed reactor, particles (sometimes catalysts) are fluidized on the reaction gas stream. As the carbon is formed, it can attach to the particles. As the carbon builds up on the particles, they become bigger and are either pushed out of the reactor or drop to the bottom for separation. In another example, the pyrolysis reactor can include molten salt or molten metal catalyst reactors. In this example, the carbon forms within the molten salt. Then, by nature of being less dense than the molten salt, the carbon floats to the top of the bed of molten salts, where it can be fluidized or skimmed off the surface. However, each of these design choices imposes other restrictions on the pyrolysis reactor (e.g., requiring the use of molten salts), which can undermine the efficiency of the pyrolysis reaction and/or be overly costly to implement.

Systems and methods for removing carbon from the pyrolysis reactor are disclosed herein. For example, as discussed in more detail below, a pyrolysis reactor according to the present technology can include a combustion component that is fluidly couplable to a combustion fuel supply (e.g., a supply of methane, natural gas, hydrogen gas, and/or the like), as well as a reaction chamber that is thermally coupled to an output of the combustion component. The reaction chamber is also fluidly couplable to a pyrolysis fuel supply (e.g., a supply of methane, natural gas, and/or the like). As a result, the reaction chamber can receive an incoming flow of the pyrolysis fuel and transfer heat from the combustion component to the pyrolysis fuel. As discussed above, the heat can drive a pyrolysis reaction, thereby generating an output flow that includes hydrogen gas and carbon particulates. Further, the pyrolysis reactor can include a carbon removal component that is operably coupled to the reaction chamber. For example, the carbon removal component can include an actuator, a rod coupled to the actuator, and a scraper head coupled to a distal end region of the rod and positioned within the reaction chamber. The actuator can drive movement of the rod (e.g., a push rod, rotatable rod, and/or the like) within the reaction chamber, thereby driving movement of the scraper head. The scraper head can include a plurality of teeth that are positioned to scrape carbon deposits from an interior wall of the reaction chamber as the actuator drives the movement.

The carbon removal component can also include a sealing device that is operably coupled between the rod and an end region of the reaction chamber. The sealing device allows movement of the rod (e.g., along a longitudinal axis of the reaction chamber, rotating about the longitudinal axis, and/or the like) while restricting (e.g., blocking and/or otherwise impeding) a flow of gas out of the end region of the reaction chamber. That is, the sealing device allows the rod to move while preventing any reaction gasses (e.g., pyrolysis fuel, hydrogen gas, and/or the like) from escaping from the reaction chamber.

In some embodiments, the pyrolysis system includes a plurality of reaction chambers. In such embodiments, the carbon removal component can include a plurality of rods and scraping heads corresponding to each of the plurality of reaction chambers. In some such embodiments, the rods can each be coupled to a strongback component that is coupled to the actuator, allowing each of the rods to be actuated together.

For ease of reference, the pyrolysis systems, and the components thereof, are sometimes described herein with reference to top and bottom, upper and lower, proximal and distal, upwards and downwards, and/or horizontal plane, x-y plane, vertical, or z-direction relative to the spatial orientation of the embodiments shown in the figures. It is to be understood, however, that the pyrolysis systems, and the components thereof, can be moved to, and used in, different spatial orientations without changing the structure and/or function of the disclosed embodiments of the present technology.

Further, although primarily discussed herein in the context of removing carbon from a hydrocarbon pyrolysis system, one of skill in the art will understand that the scope of the technology disclosed herein is not so limited. For example, the carbon removal systems can be implemented in various other chemical processing applications and/or reactor systems to address various other solid buildups and/or to reduce fouling in the other systems. That is, the embodiments of the present technology introduced above can allow continuous removal of solids built up in any chemical reactor, solids precipitator, cryogenic condenser, or other system where solids build up during operation of the system. In a specific, non-limiting example, the product stream from a pyrolysis reactor can be sent to a condensing component to be cooled to a low temperature to solidify and collect organic compound byproducts from the product stream. The organic compound byproducts can then be removed mechanically from the condensing component using trimmer systems of the type disclosed herein without pausing the operation of the pyrolysis system. Accordingly, the scope of the invention is not confined to any subset of embodiments, and is confined only by the limitations set out in the appended claims.

The embodiments of the present technology introduced above provide systems and methods for removing the solid carbon deposit (and/or other solid deposits) from a pyrolysis reactor in situ, without the need to stop or otherwise interrupt the pyrolysis reaction, and without directly generating CO or CO2. As a result, embodiments of the present technology can allow a pyrolysis reactor (and/or other processes that need to mitigate coke and/or fouling) to run continuously (or generally continuously) without needing to switch to a backup reactor and/or without needing to factor in downtime. As used herein, "continuous" operation can refer to generally continuous operation of the pyrolysis system, which can include operating the pyrolysis system without needing to pause to clean or otherwise empty the reaction chamber for periods of at least 3 hours, 6 hours, 12 hours, 24 hours, 48 hours, 72 hours, 1 week, 1 month, 6 months, and/or longer periods. Continuous operation can include operation of the pyrolysis system that periodically pauses, e.g., when demand for hydrogen gas goes down (or goes to zero), and/or pauses to allow components of the pyrolysis reactor to be serviced (e.g., for maintenance), and/or pauses when particular reaction conditions need to be met (e.g. microwave heating can shut off when actuation of the trimmer occurs so as to not have the end effector interfere with the electromagnetic heating).

The continuous operation without downtime and/or thermal cycling (e.g., switching to the backup reactor) can help reduce costs associated with the pyrolysis reactors because the continuous pyrolysis system does not require multiple pyrolysis reactors to allow one pyrolysis reactor to be reset while another reactor is operating. Additionally, or alternatively, continuous operation can lower operating expenses associated with a pyrolysis system because the capital expense has a high utilization fraction. Additionally, or alternatively, continuous operation can allow the continuous pyrolysis system to fit into a smaller footprint (e.g., because the system does not require thermal cycling to remove carbon).

Further, the embodiments of the present technology introduced above can allow a pyrolysis system to operate without catalyst entrapment, consumables, and/or catalyst post-processing. The omission of these components can help reduce the operating costs and footprint of the pyrolysis reactor and its associated balance of plant. Still further, the embodiments of the present technology introduced above can allow a pyrolysis system to operate without requiring onsite utilities like high-pressure or high-temperature water or steam. In turn, the non-requirement for high pressure or temperature water or steam enables the continuous pyrolysis system to be operational at non-industrial sites, such as within or located at a single-family household, within or located at an apartment building, within or located at a commercial building (e.g., an office building, a retail store, restaurant, and/or the like), at an industrial site without high-pressure steam or water, and/or the like. Additionally, the non-requirement for high-pressure or temperature water or steam can reduce the operational costs, capital costs, and/or footprint associated with the continuous pyrolysis system.

Additionally, or alternatively, the embodiments of the present technology introduced above can allow a pyrolysis system to operate without requiring a consumable carbon scaffold, without the direct formation of CO or CO2 (thereby enabling the production of low (or negative) carbon intensity (CI) hydrogen), and/or operate at higher thermal efficiencies than reactor systems that require downtime. Still further, the embodiments of the present technology introduced above can allow a pyrolysis system to be amenable to a range of pyrolysis geometries, such as pyrolysis contained in individual tubes that are heated externally, annular pyrolysis zones that are heated internally, and/or a system that has parallel combustion tubes with the pyrolysis zone between these tubes.

Additional details on various aspects of the pyrolysis system, and components thereof, are set out below with respect to FIGS. 1-31.

FIG. 1 is a schematic block diagram of a pyrolysis system 100 configured in accordance with embodiments of the present technology. In the illustrated embodiments, the pyrolysis system 100 includes a pyrolysis reactor 110, as well as a product stream processing component 120 and a flue gas processing component 130 each operably coupled to the pyrolysis reactor 110. The pyrolysis reactor 110 includes a reaction chamber 112 and a combustion component 114. The reaction chamber 112 is operably couplable to a pyrolysis fuel supply 10 to receive a hydrocarbon reactant (e.g., natural gas, pure methane, gasoline, diesel, biomass, biogas, organic and semi-organic waste material, and/or the like) along a first path (A). The first path (A) can include one or more valves (or another suitable flow control component) and pipes to couple the reaction chamber 112 to a natural gas supply or pipeline (and/or any other supply of the pyrolysis fuel). The reaction chamber 112 can use heat received from the combustion component 114 to raise the temperature of the hydrocarbon reactant and supply the required activation energy for hydrocarbon pyrolysis. As a result, the reaction chamber 112 causes a pyrolysis reaction that breaks the hydrocarbon reactant into hydrogen gas and carbon. Returning to the natural gas example above, the reaction chamber 112 can use heat from the combustion component 114 to heat the hydrocarbon reactant to (or above) about 650° C. to start the pyrolysis reaction.

The combustion component 114 can provide the heat for the pyrolysis reaction to occur. In some embodiments, the combustion component 114 includes one or more burners that receive and combust a combustion fuel. As illustrated in FIG. 1, the combustion component 114 is fluidly couplable to a combustion fuel supply 12 to receive a combustion fuel along a second path (B) (e.g., one or more valves and/or fluid pipelines couplable to the fuel supply 12). The combustion fuel can include various hydrocarbons (e.g., natural gas, pure methane, gasoline, diesel, and/or the like) and/or hydrogen gas from a previous pyrolysis reaction in the reaction chamber 112.

The combustion component 114 is thermally coupled to the reaction chamber 112 to receive heat along a third path (C). In some embodiments, the pyrolysis reactor is a combined combustion and pyrolysis reactor ("CCP reactor") that provides continuous combustion and pyrolysis for any suitable amount of time. For example, the combustion component 114 can include one or more burners and a combustion chamber. Further, the reaction chamber 112 can be coupled to the combustion component 114 through a heat exchanger, a shared wall between the reaction chamber 112 and the combustion chamber, a flow of flue gas from the combustion component 114 in contact with a wall of the reaction chamber 112, and/or any other suitable mechanism. In another example, the combustion component is integrated with the reaction chamber 112. For example, the combustion component 114 can include a burner positioned to combust the combustion fuel and direct the flue gas directly through the reaction chamber 112. In such embodiments, the combustion component 114 (and/or any other suitable component of the pyrolysis reactor) can control the amount of oxygen available in the reaction chamber such that all (or almost all) of the available oxygen is consumed combusting the combustion fuel supply. That is, the combustion component 114 (and/or another suitable component) can help make sure no oxygen is present to disrupt the pyrolysis reaction. Additional details on examples of suitable pyrolysis reactors, and the thermal coupling between the reaction chamber 112 and the combustion component 114, are set out in U.S. Patent Publication No. 2021/0380407 to Ashton et. al, U.S. Patent Publication No. 2022/0315424 to Ashton et. al, and U.S. Patent Publication No. 2022/0120217 to Ashton et. al, and U.S. Patent Publication No. 2022/0387952 to Groenewald et al., each of which is incorporated herein by reference in their entireties.

Further, it will be understood that while specific examples of the pyrolysis reactor 110 have been discussed herein, the technology is not so limited. For example, in some embodiments, the reaction in the reaction chamber 112 can be driven by a thermal coupling to another suitable component (e.g., a home heating device, such as a furnace, water boiler, steam boiler, plasma device, and/or the like) coupled to the hydrocarbon reactant (e.g., in and/or upstream of the reaction chamber 112); a catalytic heater coupled to the hydrocarbon reactant; an electrical heating component coupled to the hydrocarbon reactant; a microwave component operably coupled to the hydrocarbon reactant (e.g., to microwave gas in the reaction chamber 112); and/or any other suitable component. In a specific, non-limiting example, the reaction chamber 112 can include molten salt that is heated by electrical heaters and/or hot gas from another suitable component and/or a fluidized bed reactor with or without a catalyst. In this example, the molten salt can heat the incoming hydrocarbon reactant to cause the pyrolysis reaction.

As further illustrated in FIG. 1, the pyrolysis reactor 110 also includes a carbon removal component 116 that is operably coupled to the reaction chamber 112. As discussed in more detail below, the carbon removal component 116 (sometimes also referred to herein as a "carbon scraper component," a "trimmer," and/or the like) can help address carbon buildup within the reaction chamber 112 by actuating (e.g., linearly and/or rotationally) into and/or within the reaction chamber. More specifically, the carbon removal component can include one or more heads that scrape, scrub, abrade, scratch, and/or otherwise dislodge (referred to collectively using "scrape" herein) solid carbon from the walls of the reaction chamber 112 as the carbon removal component 116. Further, the carbon removal component 116 can include one or more sealing devices that allow the scraping heads to be actuated from outside of the reaction chamber 112 without letting any reaction gasses (e.g., pyrolysis fuel gas, hydrogen gas, byproduct gasses, combustion gas, combustion flue gas, and/or the like) escape from the reaction chamber 112. As a result, the carbon removal component 116 can help remove carbon from the reaction chamber 112 without pausing or otherwise disrupting operation of the pyrolysis reactor 110. That is, the carbon removal component 116 can allow the pyrolysis reactor 110 to be operated continuously (or generally continuously) while avoiding (or reducing) the deleterious effects of the carbon buildup.

As further illustrated in FIG. 1, the reaction chamber 112 (or another suitable component of the pyrolysis system 100) can direct an output from the reaction chamber 112 (sometimes referred to herein as a "product stream") into the product stream processing component 120 along a fourth flow path (D). The product stream processing component 120 includes various product separators, compressors, gas processors, and/or the like to separate products in the output flow from each other and, in some embodiments, condition the separated products for downstream uses. For example, the product stream processing component 120 can include a carbon separation component (e.g., a cyclone separator, one or more filters (e.g., a mesh filter, a baghouse filter, and/or the like), a gas-liquid separator, and/or any other suitable separator) to remove carbon (and other particulates) from the gasses in the output flow. The gasses can then be filtered (e.g., via one or more organic compound separation components, one or more gas separators, and/or the like) and/or conditioned to separate the hydrogen gas (and/or unreacted hydrocarbons) from other gasses in the output flow. The resulting hydrogen can then be conditioned (e.g., compressed, cooled, filtered again, and/or the like) and directed along a fifth flow path (E) to a hydrogen consumption component 20.

The hydrogen consumption component 20 can include (or be coupled to) a variety of end locations. For example, the hydrogen consumption component 20 can include (or be coupled to) a hydrogen storage (or local consumption point, such as the combustion component 114, a heating unit coupled to the pyrolysis system 100, a power generation component coupled to the pyrolysis system 100, and/or the like). The hydrogen storage can allow the hydrogen gas to be consumed locally as needed (e.g., during peak demand for power, to augment and/or replace a hydrocarbon gas to drive the combustion component 114, and/or the like). As used herein, local consumption can mean within the same building as the pyrolysis system 100, within the same property as the pyrolysis system 100, within a half mile of the pyrolysis system 100, within about 5 miles of the pyrolysis system 100, within an endpoint for public utilities (e.g., the consumption does not require any public utility line or public transportation means between the pyrolysis system 100 and the point of consumption), and/or the like. In another example, the hydrogen consumption component 20 can include (or be coupled to) a hydrogen grid (e.g., a public utility grid, such as a dedicated hydrogen grid) and/or into the natural gas grid. In some embodiments, the hydrogen consumption component 20 can provide hydrogen gas to the combustion component 114 to supplement, augment, and/or replace other combustion fuels (e.g., to replace, fully or in part, natural gas as the combustion fuel). In embodiments where the hydrogen gas is directed into the natural gas grid, a volume of the hydrogen directed into the natural gas grid can be controlled such that the hydrogen gas is less than about 20% of the gas, by volume, in the natural gas pipeline. Limiting the amount of hydrogen gas in the natural gas pipeline can limit risks associated with the hydrogen gas in the natural gas grid, while also helping to partially decarbonize the natural gas grid. In another example, the hydrogen consumption component 20 can include (or be coupled to) a supply grid for hydrogen-powered electronics, vehicles, machines, and/or the like. For example, the supply grid can provide the hydrogen gas to fuel cell electric vehicles (FCEVs), H2 internal combustion engines (H2 ICE) powered vehicles, and/or the like. In yet another example, the hydrogen consumption component 20 can include (or be coupled to) a combined heat and power device (e.g., rather than to the hydrogen storage) to be consumed. Examples of suitable combined heat and power devices are disclosed in U.S. Patent Publication No. 2022/0387952 to Groenewald et. al, and U.S. Patent Publication No. 2022/0120217 to Ashton et. al, each of which is incorporated herein by reference. Additionally, or alternatively, the hydrogen consumption component 20 can include (or be coupled to) a power generation device (e.g., a combustion engine, thermionic converter, linear generator, fuel cell, and/or other suitable power generator). In yet another example, the hydrogen consumption component 20 can include (or be coupled to) a chemical processing component that uses the hydrogen gas for various other chemical processing operations.

Similarly, the product stream processing component 120 can direct the carbon removed from the product stream along a sixth flow path (F) toward a carbon consumption component 30 (or carbon processing component). The carbon consumption component can use or store the carbon to help ensure that the carbon is not eventually released as carbon dioxide. That is, the carbon consumption component 30 can help finalize the carbon capture from the pyrolysis fuel. In various embodiments, the carbon consumption component 30 can include a collection bin, a processing component that prepares the carbon to be used (or uses the carbon) in various applications. Purely by way of example, the carbon consumption component 30 can prepare the carbon to be used as a binder replacement and/or supplement for asphalt products.

In some embodiments, the product stream processing component 120 includes one or more heat exchangers and/or recuperators to absorb heat from the product stream. For example, the product stream processing component 120 can absorb heat from the product stream and transfer the heat to incoming pyrolysis fuel in the first flow path (A) and/or incoming combustion fuel in the second flow path (B) to preheat the incoming gasses. The preheating process can help increase an efficiency of the pyrolysis reactor 110 and/or a completeness of the pyrolysis reaction within the reaction chamber 112. Additional details on examples of suitable recuperators are disclosed in U.S. Patent Publication No. 2022/0315424 to Ashton et. Al and U.S. Patent Publication No. 2022/0120217 to Ashton et. Al, each of which is incorporated herein by reference. Additionally, or alternatively, the heat can be directed to one or more heating units (e.g., an HVAC unit, water heater, steam boiler, and/or the like), a power generation device (e.g., the combined heat and power component 44, a thermionic device, thermoelectric device, fuel cell, thermoacoustic device, and/or any other suitable power generator), and/or the like.

As further illustrated in FIG. 1, the combustion component 114 (or another suitable component of the pyrolysis system 100) can direct an output from the combustion component 114 (e.g., flue gas, when separate from the product stream) into the flue gas processing component 130 along a seventh flow path (G). The flue gas processing component 130 can process (e.g., filter, clean (e.g., absorb carbon dioxide and/or other gasses from), compress, decompress, cool, and/or the like) before directing the flue gas to a flue gas vent 40 (e.g., an exhaust system). For example, similar to the discussion above, the flue gas processing component 130 can include one or more heat exchangers. The heat exchangers can absorb at least a portion of the heat remaining in the flue gas to recycle the heat. For example, the flue gas processing component 130 (or another suitable component) can direct heat from the heat exchanger into contact with incoming air for the combustion component 114. As a result, the heat exchanger can preheat the incoming air, thereby reducing the temperature difference between the incoming air and the combustion temperature. As a result, the combustion component 114 does not need to raise the temperature of the incoming air as far to initiate combustion, thereby improving the efficiency of the combustion component 114. In another, similar example, the flue gas processing component 130 can be coupled to the combustion fuel supply 12 to receive the combustion fuel. In this example, the heat exchanger in the flue gas processing component 130 can preheat the combustion fuel upstream from the combustion component 114. As a result, the combustion component 114 does not need to raise the temperature of the incoming combustion fuel as far to initiate combustion, thereby improving the efficiency of the combustion component 114. In yet another example, the flue gas processing component 130 can recycle the heat for an external appliance, such as a heating unit (e.g., an HVAC unit, water heater, steam boiler, and/or the like), a power generation device (e.g., a combined heat and power component, a thermionic device, thermoelectric device, thermoacoustic device, a fuel cell, and/or any other suitable power generator), and/or the like.

In various embodiments, the pyrolysis system 100 can omit one or more of the components discussed above and/or include one or more additional components. For example, in embodiments where the combustion component 114 includes a burner positioned to direct the flue gas directly through the reaction chamber 112, the flue gas is mixed with the product stream. Accordingly, in this example, the pyrolysis system 100 can omit the separate flue gas processing component 130 and instead integrate any needed functionality into the product stream processing component 120 (e.g., adding a water vapor condenser and/or a carbon dioxide absorber to the product stream processing component 120 to separate components of the flue gas from the product stream). In another example, the pyrolysis system 100 can include a variety of additional processing components downstream from the pyrolysis reactor 110 to help separate and/or process the product stream (e.g., to help separate byproducts from the pyrolysis reaction, to further condition the hydrogen gas for consumption at an endpoint, and/or the like). In yet another example, although not illustrated in FIG. 1, it will be understood that the pyrolysis system 100 can include a controller operatively coupled to any suitable component of the pyrolysis system 100 to control (or help control) the operation thereof. For example, the controller can include a memory and processor that are coupled to the reaction chamber 112 and/or combustion component 114 to help control the amount and/or operating parameters of the pyrolysis reaction, the carbon removal component 116 to help control the actuation cycles of the carbon removal component 116, and/or the like.

Figure 2A:
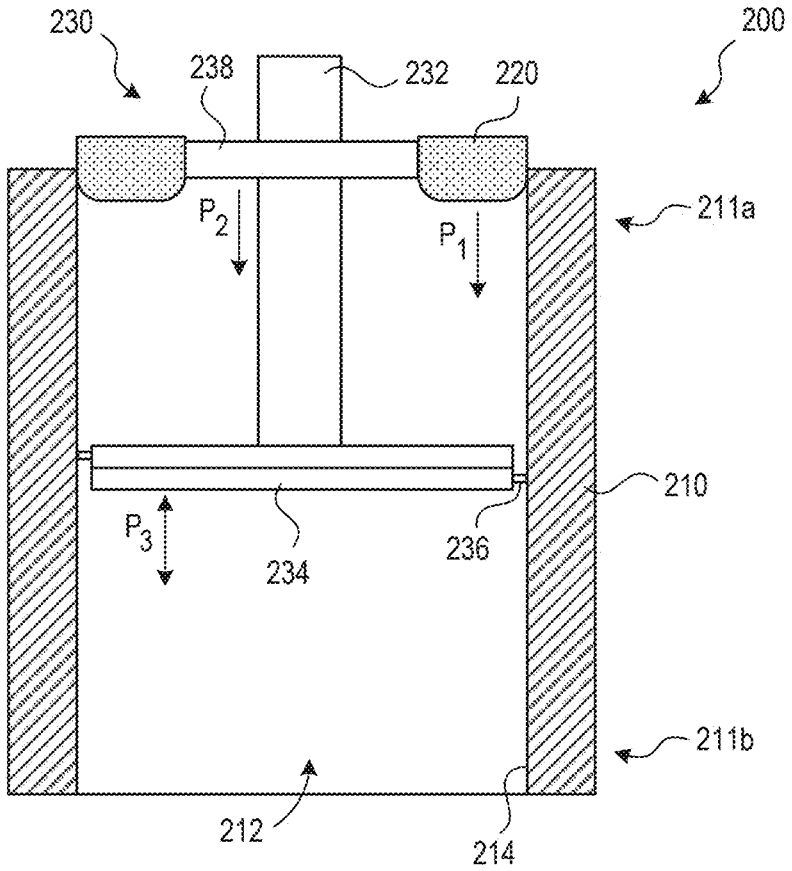
FIGS. 2A and 2B are schematic cross-sectional and top views, respectively, of a portion of a pyrolysis reactor configured in accordance with embodiments of the present technology.
Figure 2B:
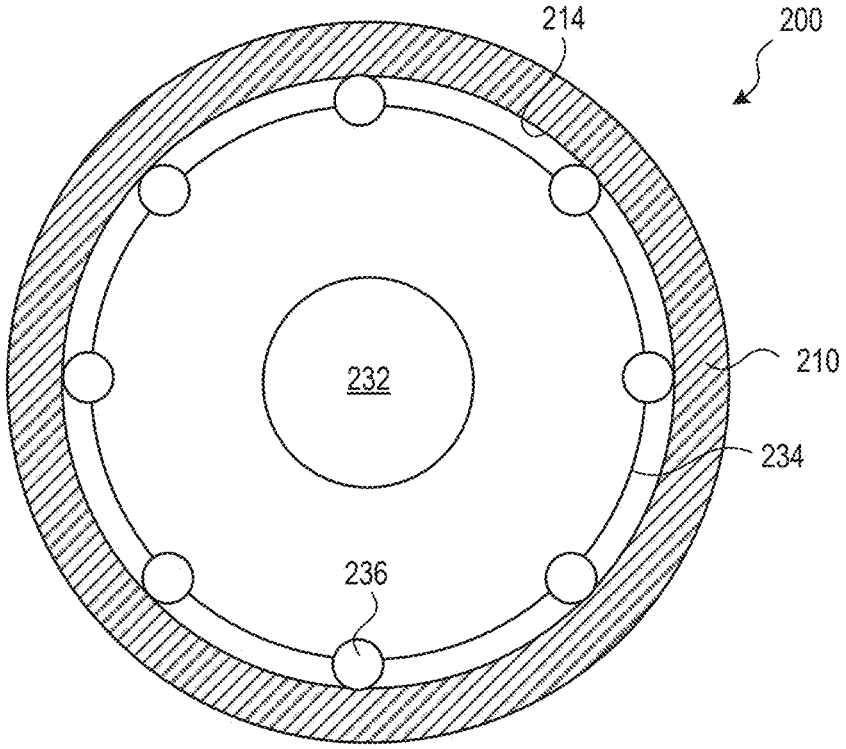

Examples of Suitable Carbon Removal Components in Accordance with Embodiments of the Present Technology FIGS. 2A and 2B are schematic cross-sectional and top views, respectively, of a portion of a pyrolysis reactor 200 configured in accordance with embodiments of the present technology. As best illustrated in FIG. 2A, the pyrolysis reactor 200 includes a combined combustion and pyrolysis (CCP) chamber 210 with a flow path 212 from a first end 211*a* of the CCP chamber 210 to a second end 211*b* of the CCP chamber 210. The pyrolysis reactor 200 also includes a combustion component 220 (e.g., an annular burner system) and a carbon removal component 230. The combustion component 220 is positioned at the first end 211*a* to direct flue gas along a first flow path $P_1$ generally along the flow path 212 through the CCP chamber 210. The carbon removal component 230 includes a sealing device 232, a rod 234, and a scraping head 236. The sealing device 232 is positioned at the first end 211*a* to allow a pyrolysis reaction fuel to flow into (and through) the CCP chamber 210 along a second flow path $P_2$ while preventing gasses (e.g., the pyrolysis fuel, combustion gasses, flue gasses, pyrolysis reaction products, and/or the like) from escaping the CCP chamber 210 at the first end 211*a*. Said another way, the combustion component 220 and the sealing device 232 create a gas-tight seal at the first end 211*a*.

In various embodiments, the sealing device 232 can include a wiper, scraper, and/or other similar features for removing fluidized carbon from the surface of the rod 234 (e.g., a push rod, rotatable rod, and/or the like). In some embodiments, the sealing device 232 includes a set of seals for creating a pressure plenum. The pressure plenum can be controlled to a pressure that is higher than a pressure inside the pyrolysis reactor 200 (e.g., inside the CCP chamber 210). As a result, if the sealing device 232 leaks, the leak directs gas into the CCP chamber 210 and helps prevent product gasses from leaking outside the CCP chamber 210. In some embodiments, the pressure plenum is held at a gauge pressure of at least 1 pound per square inch (psi), at least 5 psi, at least 18 psi, or least 25 psi, at least 100 psi, at least 1000 psi, or at least 10000 psi. In various embodiments, the pressure plenum can include an inert gas (e.g., Argon, Nitrogen, or other noble gas, and/or another suitable inert gas); a hydrocarbon-based lubricant (e.g., mineral oil, motor oil, and/or other suitable lubricant); a sealing material capable of withstanding relatively high transient temperatures (e.g., transient temperature of at least 100° C., at least 200° C. or at least 300° C.). This relatively high heat resistance can help avoid deleterious effects when the rod 234 increases in temperature from heat within the CCP chamber 210. In some embodiments, a flushing fluid is pumped through the pressure plenum periodically to remove solid deposits (e.g., carbon deposits) that have built up, without pausing or otherwise interrupting the pyrolysis reactor 200.

Further, as illustrated in FIG. 2A, the second flow path $P_2$ can be generally parallel with and co-directional with the flow path 212 through the CCP chamber 210 (and the first flow path $P_1$). As a result, the pyrolysis fuel entering the CCP chamber 210 will interact with the flue gas from the combustion component 220, thereby directly heating the pyrolysis fuel. However, it will be understood that the technology is not so limited. For example, the second flow path $P_2$ can be generally parallel with and opposite the flow path 212 through the CCP chamber 210 (and the first flow path $P_1$). The opposite arrangement can be beneficial to provide the flue gas with time to transfer the heat. As the pyrolysis fuel rises in temperature, a pyrolysis reaction of the type discussed above takes place within the CCP chamber 210. As a result, a product stream that includes hydrogen gas and solid carbon (among various byproducts, flue gasses, and/or unreacted pyrolysis fuel gasses) is formed within the CCP chamber 210. While most of the product stream will continue along the flow path 212 and out of the second end 211*b*, a portion of the solid carbon particulates precipitates onto and/or otherwise coats an internal wall 214 of the CCP chamber 210.

As further illustrated in FIG. 2A, the sealing device 232 can allow the rod 234 to actuate within the CCP chamber 210. For example, the rod 234 can move along a third path $P_3$ generally parallel to a longitudinal axis of the CCP chamber 210 (e.g., along the flow path 212), thereby also driving motion of the scraping head 236. During the actuation, scraping components 238 (sometimes also referred to herein as "teeth") carried by the scraping head 236 scrape against carbon deposited on the internal wall 214. The scraping can help dislodge the carbon to keep the internal wall 214 clean and/or maintain available flow paths for the product stream through the CCP chamber 210.

In some embodiments, the rod 234 has a surface that is relatively smooth (e.g., with a surface roughness (measured in Ra) that is less than about 32 pin, or less than about 16 μin). Rougher surfaces undermine the ability of the sealing device 232 to provide an adequate seal and/or cause premature degradation of the sealing device 232. In some embodiments, the rod 234 has a thermal diffusivity that is greater than about 1 square millimeter per second ($mm^2/s$). In some embodiments, the thermal diffusivity is greater than about 3 $mm^2/s$. In some embodiments, the hardness of the surface of the rod 234 is greater than about Rockwell C50. In some embodiments, the hardness of the surface of the rod is greater than about Rockwell C60.

In various embodiments, the scraping components 238 can include tungsten, molybdenum, cubic boron nitride (CBN), cobalt, polycrystalline diamond (PCD), diamond-like carbon, high-speed steel, tungsten carbide, micrograin tungsten carbide, silicon nitride, silicon carbide, tantalum carbide, various ceramics and/or ceramets, cemented carbides, superalloys, steel, titanium carbide, and/or other suitable materials. In general, the scraping components 238 can last longer and/or more effectively remove carbon (and other materials collecting on the internal wall 214) when the hardness of the scraping components 238 is matched or greater than the hardness of the materials being removed. In some embodiments, the scraping components 238 can include a coating to help increase the hardness of the scraping components 238, such as TIN, TiC, Ti(C)N, TiAIN, cubic-BN, polycrystalline diamond, diamond-like carbon, SiC, and/or other suitable materials. In a specific, non-limiting example, the scraping components 238 are a carbide with a TiN, cubic-BN, and/or polycrystalline diamond coating.

In some embodiments, a geometry of the scraping components 238 is generally matched to the length scale of the deposit being removed. For example, at steady-state operation, the carbon deposits will grow at a constant (or generally constant) rate. The height of the scraping components 238 (e.g., measured as a distance from the scraping head 236) must be generally equal to or greater than the thickness of the carbon that is deposited between actuations to prevent the scraping head 236 from hitting the carbon. If the scraping head 236 hits the carbon, then the required actuation force dramatically increases, increasing the risk of damage to the caron removal component 230 and/or the pyrolysis reactor 200 overall. In some embodiments, the pyrolysis reactor 200 continuously actuates the rod 234 during operation, allowing the scraping head 236 to continuously clean the internal wall 214. In some embodiments, the pyrolysis reactor 200 periodically actuates the rod 234 during operation (e.g., after a predetermined time period, in response to a detection of pressure buildup in the CCP chamber 210 indicating carbon buildup, and/or the like).

As best illustrated in FIG. 2B, the rod 234 can additionally (or alternatively) rotate along a rotational path $R_1$ (e.g., rotate about the longitudinal axis of the CCP chamber 210). The rotation can also allow the scraping components 238 carried by the scraping head 236 to scrape carbon on the internal wall 214. Additionally, or alternatively, the rotation can index the location of the scraping components 238 between (or during) actuations along the third path $P_3$ (FIG. 2A) to allow the scraping components 238 to clean a larger portion of the internal wall 214 than if they were in a fixed location.

Figure 3:
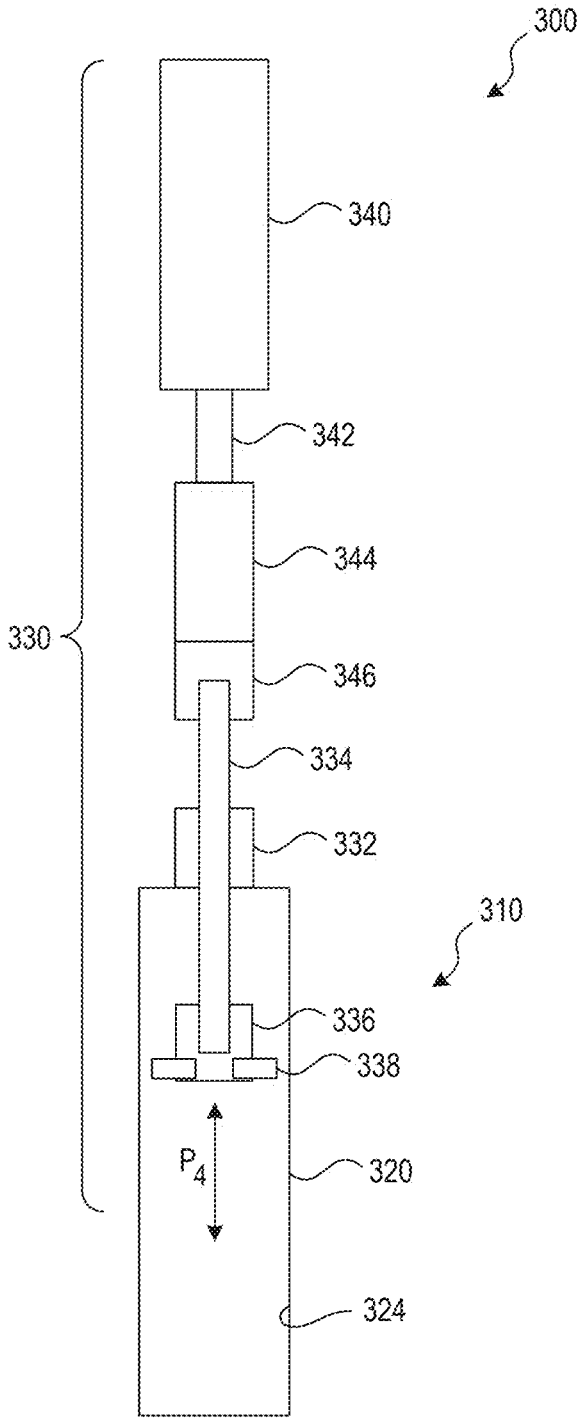
FIG. 3 is a schematic diagram of a pyrolysis system configured in accordance with embodiments of the present technology.

FIG. 3 is a schematic diagram of a pyrolysis system 300 configured in accordance with embodiments of the present technology. In the illustrated embodiments, the pyrolysis system 300 includes a pyrolysis reactor 310 that is generally similar to the pyrolysis reactor 200 discussed above with reference to FIGS. 2A and 2B. For example, the pyrolysis reactor 310 can be a CCP reactor with a CCP chamber 320 that directly heats incoming pyrolysis fuel with the flue gas from a combustion component. Further, the pyrolysis system 300 includes a carbon removal component 330 operably coupled to the CCP chamber 320 to help remove carbon (and/or any other buildups) from an internal wall 324 of the CCP chamber 320 during operation.

Similar to the carbon removal component discussed above, the carbon removal component 330 of FIG. 3 can include a sealing device 332 coupled to an end region of the CCP chamber 320, a rod 334 operably coupled to the sealing device to actuate within the CCP chamber 320 without letting gasses escape, and a scraper head 336 that includes teeth 338 carried by the rod 334 within the CCP chamber 320. As further illustrated in FIG. 3, the carbon removal component 330 can further include an actuator 340 (e.g., an actuation driver) and an actuator sled 342 coupled between the actuator 340 and the rod 334. The actuator 340 can include an electric motor, a pneumatic driver, a hydraulic driver, a piston system, a rotational driver, and/or any other suitable mechanism to actuate the rod 334 within the CCP chamber 320 (e.g., along the third motion path P3 and/or rotationally about a longitudinal axis of the CCP chamber 320). The actuator 340 must be capable of delivering sufficient force to remove the hard carbon deposited on the walls of the pyrolysis reactor 310. The force required may be between about 100 pounds (lbs) and about 200 lbs, between about 200 lbs and about 1000 lbs, about 10000 lbs, or over 10000 lbs, and is chosen depending on the size and geometry of the reactor and/or a rate at which the carbon deposits on the internal walls.

Additionally, as discussed in more detail below, the actuator can provide inputs to actuate individual components of the scraper head 336 (e.g., to rotate the teeth 338 individually, to rotate portions of the scraper head 336, and/or the like). The actuator sled 342 can help translate inputs from the actuator 340 to the rod 334 and/or the scraper head 336.

In the illustrated embodiment, the carbon removal component 330 also includes an indexing mechanism 344 and a gearbox 346. The indexing mechanism 344 can include a motor or other suitable component that translates an input with motion in a first direction (e.g., rotational motion) to an output applied to the rod 334 with motion in a second direction (e.g., linear motion). Additionally, or alternatively, the indexing mechanism 344 (sometimes also referred to herein as a "clocking mechanism") can rotate (e.g., index) the rod 334 a fixed angle prior to the start of each actuation and/or at the start of any suitable number of actuations (e.g., every one, two, three, five, ten, or other suitable number of actuations). In some embodiments, the indexing mechanism 344 can rotate the rod 334 a fixed amount partway through each actuation. The amount of rotation can be preselected such that a complete rotation of the rod 334 is achieved in a predetermined number of actuations. In some embodiments, the amount of rotation is selected such that consecutive passes of the cutting features do not fall in the same groove. In some embodiments, the number of actuations is selected such that the deposition rate of the carbon deposit does not outpace the rate of carbon removal. In various embodiments, the indexing mechanism 344 can include a pneumatic indexer, a servo motor, a belt drive system, a passive spring-loaded system, and/or any other suitable mechanism. In some embodiments, the actuator 340 and the actuator sled 342 output motion in the necessary directions, allowing the rod 334 to be coupled directly to the actuator sled 342.

Similarly, the gearbox 346 can translate a magnitude and/or torque of an input from the actuator 340 as suitable for the rod 334. As a result, for example, the gearbox 346 can help increase a force applied to the rod 334 by the actuator 340 to help ensure the rod 334 has sufficient force to scrape hard carbon deposits off the internal wall 324. In some embodiments, however, the carbon removal component omits the gearbox 346 (e.g., in applications where the magnitude of the force needed to scrape the carbon is relatively small).

In some embodiments, the pyrolysis system 300 is at least partially controlled by a controller (not shown) implementing a control algorithm. For example, the control algorithm can help determine an appropriate number of actuations per minute, speed of actuations, rotations of the rod 334, force to apply to the rod 334, and/or the like to remove carbon from the CCP chamber 320 while reducing (or minimizing) maintenance required for the pyrolysis system 300 and/or power requirements for the pyrolysis system 300. In various embodiments, the control algorithm can: model the growth of the carbon deposition using an approach such as a constant rate of mass gain, a constant rate of linear thickness gain, computational fluid dynamics with empirical correlation, and/or direct numerical simulation of the reaction pathways; record the growth rate of the carbon deposit based on a sensor within or coupled to the CCP chamber 320; calculate the growth rate of the carbon deposit based on flow rates and/or pressures of input and/or output flows to the CCP chamber 320; model the rotation of the end effector between actuations; model the time between actuations; and/or combine any of the models, measurements, and/or calculations discussed above to predict the force required to remove carbon deposits with a selected scraper head 336 geometry. In some embodiments, the force prediction can be based on tool area overlap with the measured cutting pressure, an overlap of the tool perimeter with the buildup length and shear strength of the carbon, and/or empirically correlated cutting force with a selected end effector geometry.

As discussed above, the control algorithm can be used to find a balance between a clocking angle (e.g., where, up to symmetric positions, larger angles are less likely to fall into old cuts while smaller angles wear the seals less), a time between actuations (e.g., where less time between actuations reduces the removal force and more time reduces the wear on the seals), and a number of cutting features (e.g., where fewer cutting features require less force per actuation while more cutting features requires less frequent actuations). As a result, the control algorithm can help minimize the cutting force required to be applied to (and by) the rod 334 while maximizing the time between required actuations (e.g., to provide an open flow path for the pyrolysis reaction). In some embodiments, the control algorithm is executed during a design phase to help determine elements of the design (e.g., the number of scraping components, an actuation period, an indexing angle, and/or an end effector geometry).

Figure 4A:
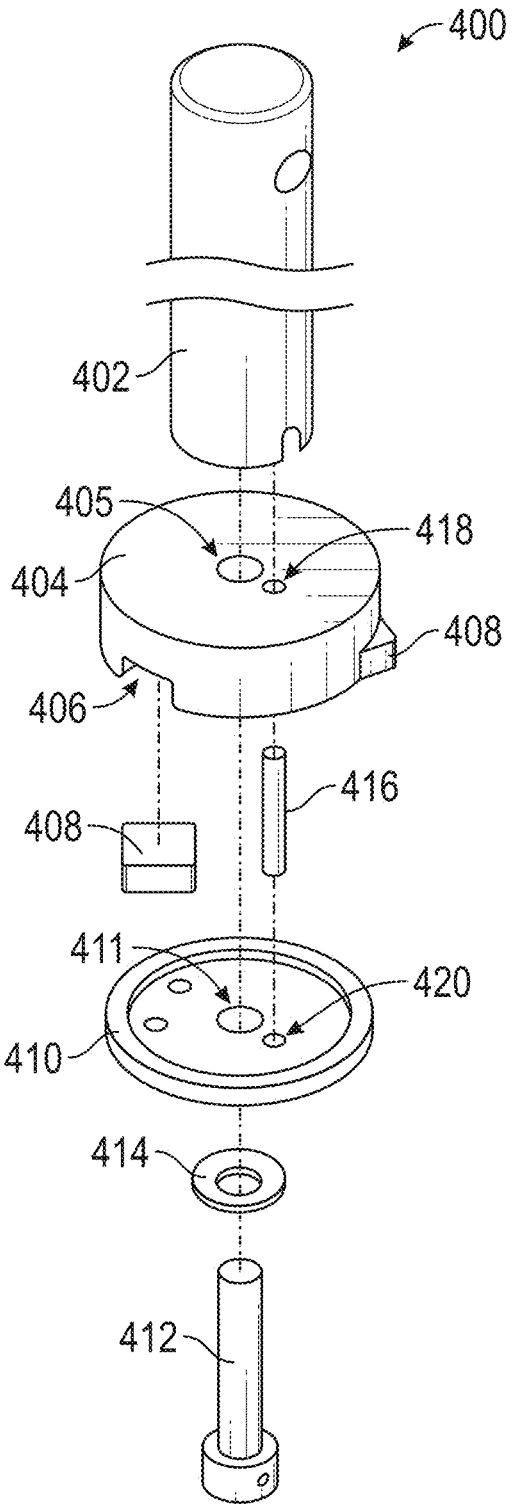
FIGS. 4A and 4B are a partially schematic exploded and isometric view, respectively, of a carbon removal component configured in accordance with embodiments of the present technology.
Figure 4B:
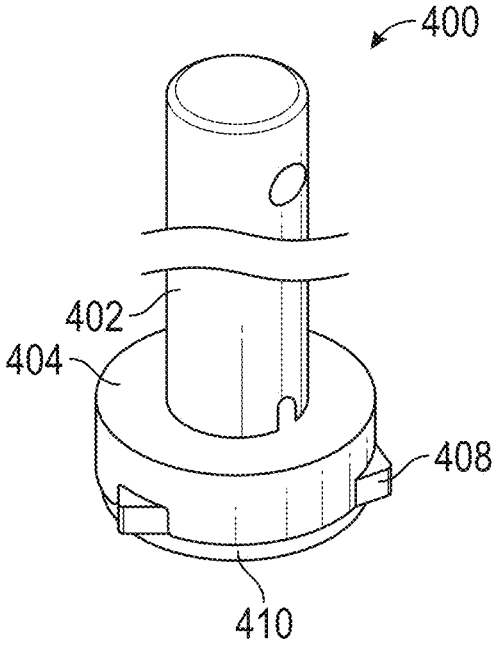

FIGS. 4A and 4B are a partially schematic exploded and isometric view, respectively, of a carbon removal component 400 configured in accordance with embodiments of the present technology. The carbon removal component 400 illustrated in FIGS. 4A and 4B can be implemented in the carbon removal components discussed above with reference to FIGS. 2A-3 to help remove carbon from a pyrolysis reactor of the type discussed above. As best illustrated in FIG. 4A, the carbon removal component 400 includes a rod 402 and a scraper head 404 coupled to a distal end region of the rod 402. The scraper head 404 (sometimes also referred to herein as a "holder," an "end effector," and/or the like) includes openings 406 distributed about a perimeter of the scraper head 404. The openings 406 are each sized to receive and help retain individual teeth 408 (e.g., sometimes also referred to herein as "cutting teeth").

As further illustrated in FIG. 4A, the carbon removal component 400 can also include an end cap 410 that is couplable to the scraper head 404 via a fastener 412 (e.g., a bolt, screw, pin, and/or any other suitable fastener). More specifically, the fastener 412 can be inserted into the scraper head 404 through a first opening 411 in the end cap 410 and a central opening 405 in the scraper head 404. As a result, as best illustrated in FIG. 4B, the end cap 410 can help secure the teeth within the scraper head 404. Conversely, returning to the description of FIG. 4A, the end cap 410 can be detached from the scraper head 404 by removing the fastener 412 from the scraper head 404. Once the end cap 410 is detached, the teeth 408 can be removed from the openings 406 in the scraper head 404, allowing the teeth to be independently rotated, serviced, and/or replaced. Said another way, the end cap 410 can be removed to provide service to the components of the carbon removal component 400, which can help extend a lifetime of the carbon removal component 400 and/or help lower operating costs associated with using the carbon removal component 400. In some embodiments, the teeth 408 are formed integrally with the scraper head 404. The integral formation of the teeth 408 with the scraper head 404 can help eliminate the need for several of the components illustrated in FIG. 4A, such as the end cap 410 and the fastener 412, which can help simplify the design of the carbon removal component 400.

In the embodiments illustrated in FIG. 4A with removable teeth, the carbon removal component 400 can further include components that help simplify and/or strengthen the connection of the components. For example, the carbon removal component 400 can include a washer 414 positionable between the end cap and the fastener 412 to help uniformly distribute the force from the fastener 412. In another example, the carbon removal component 400 can include an alignment pin 416 (e.g., a dowel insert) that can be inserted into a peripheral opening 418 in the scraper head 404 through a second opening 420 in the end cap 410 to help facilitate proper alignment between the end cap 410 and the scraper head 404 and/or to help strengthen a connection therebetween.

Figure 5:
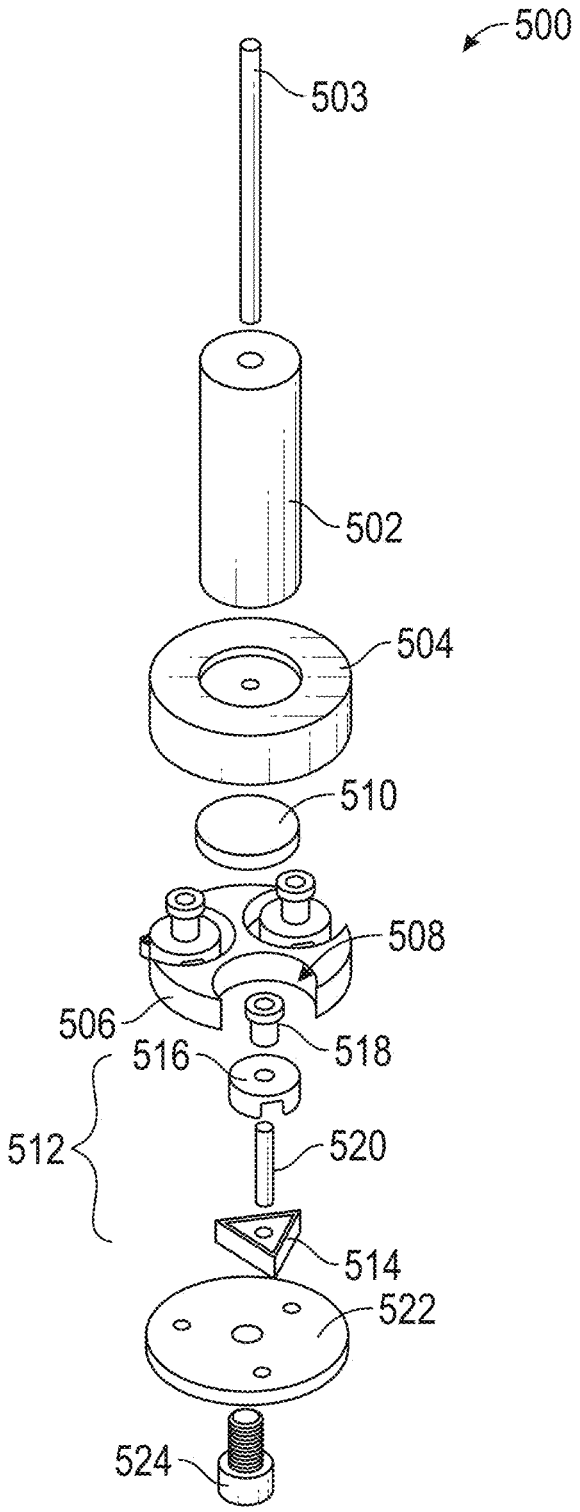
FIG. 5 is a partially schematic exploded of a carbon removal component configured in accordance with embodiments of the present technology.

FIG. 5 is a partially schematic exploded view of a carbon removal component 500 configured in accordance with embodiments of the present technology. The carbon removal component 500 illustrated in FIG. 5 can be implemented in the carbon removal components discussed above with reference to FIGS. 2A-3 to help remove carbon from a pyrolysis reactor of the type discussed above. Further, as best illustrated in FIG. 5, the carbon removal component 500 is generally similar to the carbon removal component 400 discussed above with reference to FIGS. 4A and 4B. For example, the carbon removal component 500 includes a rod 502 and a scraper head 504 coupled to a distal end region of the rod 502. Further, the scraper head 504 is couplable to an end cap 522, via a fastener 524, to retain individual teeth 514 for the carbon removal component 500.

In the illustrated embodiment, however, the carbon removal component 500 is configured to allow each of the teeth to be individually rotated without detaching the end cap 522 from the scraper head 504. For example, the carbon removal component 500 can include a rotatable-insert holder 506 that includes a plurality of openings 508 (three illustrated in FIG. 5), a sun gear 510, and a plurality of rotatable inserts 512 (three illustrated in FIG. 5). The rotatable inserts 512 can each be positioned within a corresponding one of the openings 508. The rotatable-insert holder 506 and the sun gear 510 can then be attached (or otherwise coupled) to the scraper head 504 by the end cap 522 and fastener 524. Once attached, the sun gear 510 can be operably coupled to a drive shaft 503 extending through the rod 502 and the scraper head 504. The drive shaft 503 can actuate the sun gear 510 about a longitudinal axis of the carbon removal component 500.

As further illustrated in FIG. 5, each of the rotatable inserts 512 can include an individual one of the teeth 514, an insert holder 516, a gear 518, and a fastener 520. The fastener 520 can attach the individual one of the teeth 514, the insert holder 516, and the gear 518 together. Further, when the rotatable inserts 512 are positioned within the openings 508, the gear 518 can be coupled to the sun gear 510 such that rotation of the sun gear about the longitudinal axis of the carbon removal component 500 drives rotation of the gears 518 in each of the rotatable insert 512. In turn, the rotation of the gears 518 can rotate the rotatable inserts 512, and each of the teeth 514 therein.

As a result, the teeth 514 can be rotated without deconstructing the carbon removal component 500. That is, for example, as one edge of the teeth wears down from scraping solid carbon off the walls of a reaction chamber (e.g., the internal wall 324 of FIG. 3), the carbon removal component 500 can rotate the teeth 514 to a fresh edge without requiring the carbon removal component 500 to be taken apart and serviced. The rotation can allow the teeth 514 (and the carbon removal component 500 more generally) to go through longer periods of operation without service, thereby reducing costs associated with maintaining an associated pyrolysis system and/or reducing downtime of the pyrolysis system.

Figure 6A:
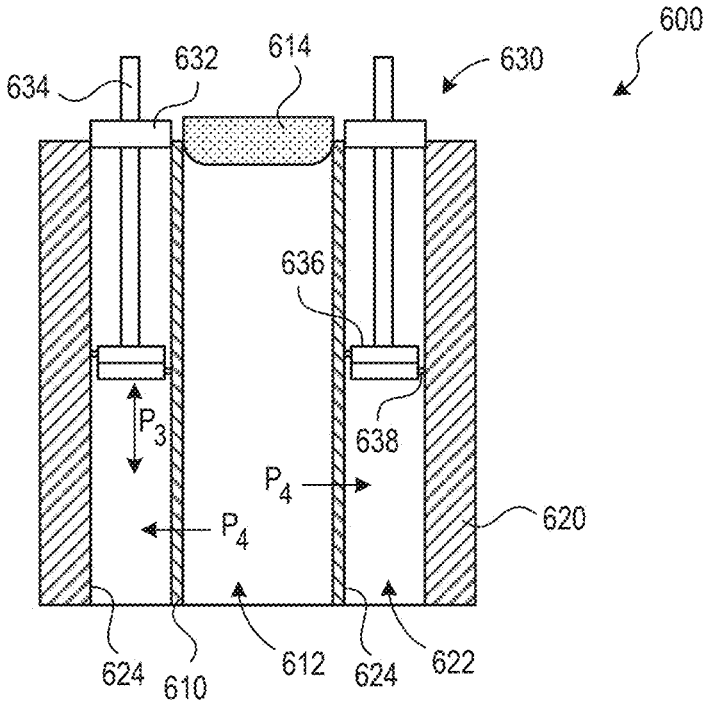
FIGS. 6A and 6B are schematic cross-sectional and top views, respectively, of a portion of a pyrolysis reactor configured in accordance with embodiments of the present technology.
Figure 6B:
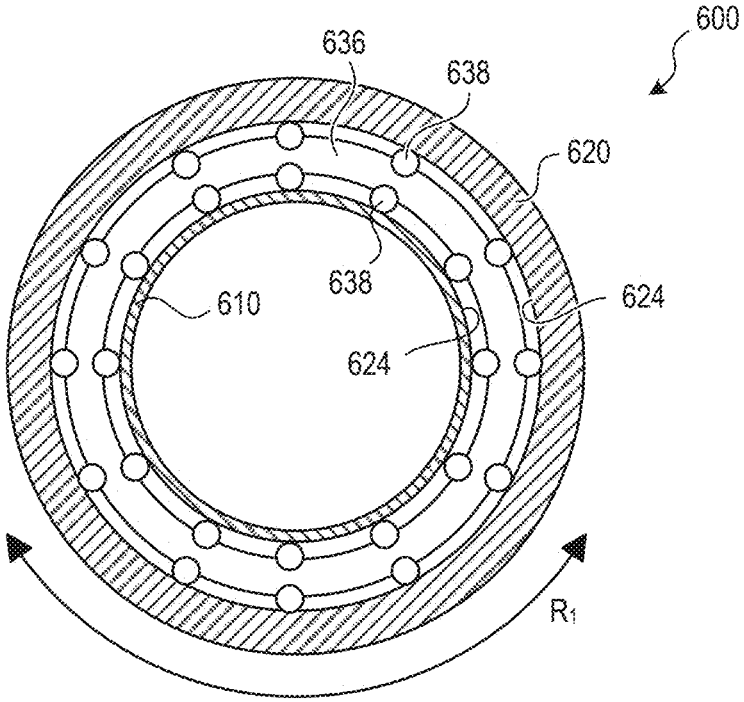

FIGS. 6A and 6B are schematic cross-sectional and top views, respectively, of a portion of a pyrolysis reactor 600 configured in accordance with embodiments of the present technology. As best illustrated in FIG. 6A, the pyrolysis reactor 600 can include a combustion chamber 610 and a reaction chamber 620 (e.g., separate chambers for a CCP reactor). The combustion chamber 610 has a combustion flow path 612 for flue gas emitted by a combustion component 614 into the combustion chamber 610. The reaction chamber 620 includes a reaction flow path 622 for a pyrolysis fuel (e.g., any suitable hydrocarbon, such as methane, natural gas, and/or the like) extending generally parallel to the combustion flow path 612. In the illustrated embodiments, the combustion chamber 610 and the reaction chamber 620 are in an annular arrangement with the combustion chamber 610 positioned within the reaction flow path 622. As a result, heat from the flue gas can pass along a fourth path $P_4$ between the combustion chamber 610 and the reaction chamber 620.

The illustrated annular arrangement positions the reaction chamber 620 entirely around the combustion chamber 610. As a result, heat can only be transferred out of the combustion chamber 610 along the fourth path $P_4$ into the reaction chamber 620 or along the combustion flow path 612. That is, all of the heat that is not carried out of the combustion chamber 610 by the flue gas is communicated into the reaction chamber 620 to heat the pyrolysis fuel. It will be understood, however, that the technology disclosed herein is not limited to the arrangement illustrated in FIG. 6A. For example, the combustion chamber 610 and the reaction chamber 620 can be positioned in an annular arrangement with the reaction chamber 620 positioned within the combustion flow path 612. In such embodiments, the reaction chamber 620 is fully surrounded by the heat source, which can help reduce the chance of cold spots within the reaction flow path 622 to help improve the completeness of the pyrolysis reaction. Further, in such embodiments, the pyrolysis reactor 600 can further include an insulating material positioned around the combustion chamber 610 to reduce the amount of heat lost peripherally from the combustion chamber. In another example, the combustion chamber 610 and the reaction chamber 620 can be positioned adjacent to each other (e.g., in a non-annular arrangement), specific examples of which are discussed in more detail below.

As the heat travels from the combustion chamber 610 to the reaction chamber 620, the heat is also transferred to the pyrolysis fuel in the reaction flow path 622 to drive a pyrolysis reaction. As discussed above, the pyrolysis reaction can generate a product stream that includes hydrogen gas and solid carbon (and/or various other byproducts and/or coproducts). As also discussed above, a portion of the solid carbon can precipitate onto and/or otherwise collect on internal walls 624 of the reaction chamber 620. If not addressed, the carbon builds up and clogs/fouls the reaction chamber 620.

As further illustrated in FIG. 6A, the pyrolysis reactor 600 can also include a carbon removal component 630 to address the carbon build-up. Similar to the components discussed above, the carbon removal component 630 can include a sealing device 632, one or more rods 634 (two shown in the cross-section of FIG. 6A), and a scraping head 636.

The sealing device 632 is positioned at a first end of the pyrolysis reactor adjacent to the combustion component 614. The sealing device 632 can allow a pyrolysis reaction fuel to flow into (and through) the reaction chamber 620 while preventing gasses (e.g., the pyrolysis fuel, pyrolysis reaction products, byproduct gasses, and/or the like) from escaping the reaction chamber 620. Further, the sealing device 632 can allow the one or more rods 634 to actuate within the reaction chamber 620. For example, the one or more rods 634 can move along a third path $P_3$ generally parallel to a longitudinal axis of the reaction chamber 620 (e.g., along the reaction flow path 622), thereby also driving motion of the scraping head 636. During the actuation, scraping components 638 carried by the scraping head 636 can scrape against carbon deposited on the internal walls 624. The scraping can help dislodge the carbon to keep the internal walls 624 clean and/or maintain available flow paths for the pyrolysis reaction fuel and the product stream through the reaction chamber 620.

As best illustrated in FIG. 6B, the scraper head 636 can additionally (or alternatively) rotate along a rotational path $R_1$ (e.g., rotate about the longitudinal axis of the reaction chamber 620). The rotation can also allow the scraping components 638 carried by the scraping head 636 to scrape carbon on the internal walls 624. Additionally, or alternatively, the rotation can index the location of the scraping components 638 between (or during) actuations along the third path $P_3$ (FIG. 6A) to allow the scraping components 638 to clean a larger portion of the internal wall 624 than if they were in a fixed location.

Figure 7A:
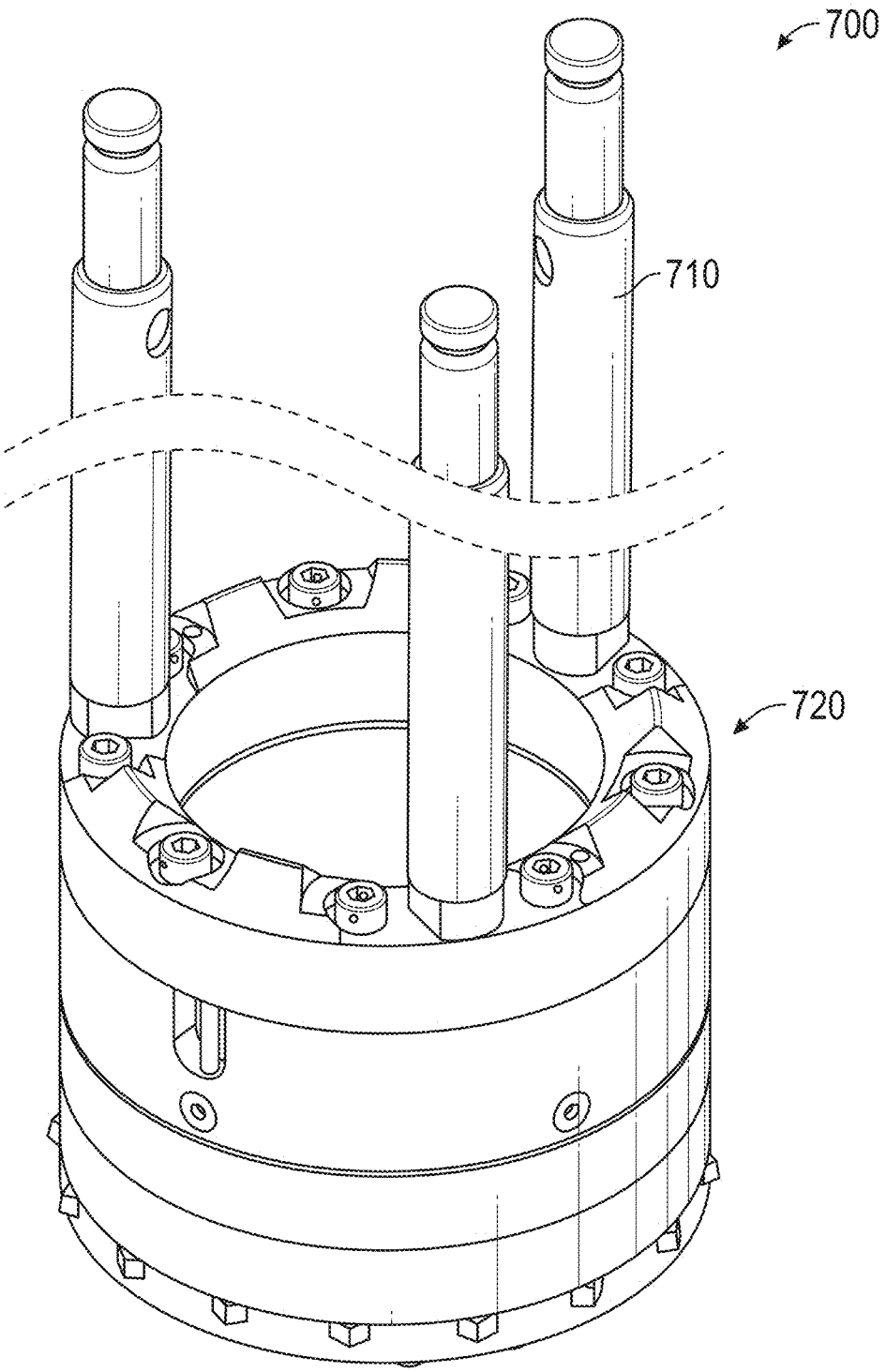
FIGS. 7A and 7B are partially schematic isometric and cross-sectional views, respectively, of a carbon removal component configured in accordance with embodiments of the present technology.
Figure 7B:
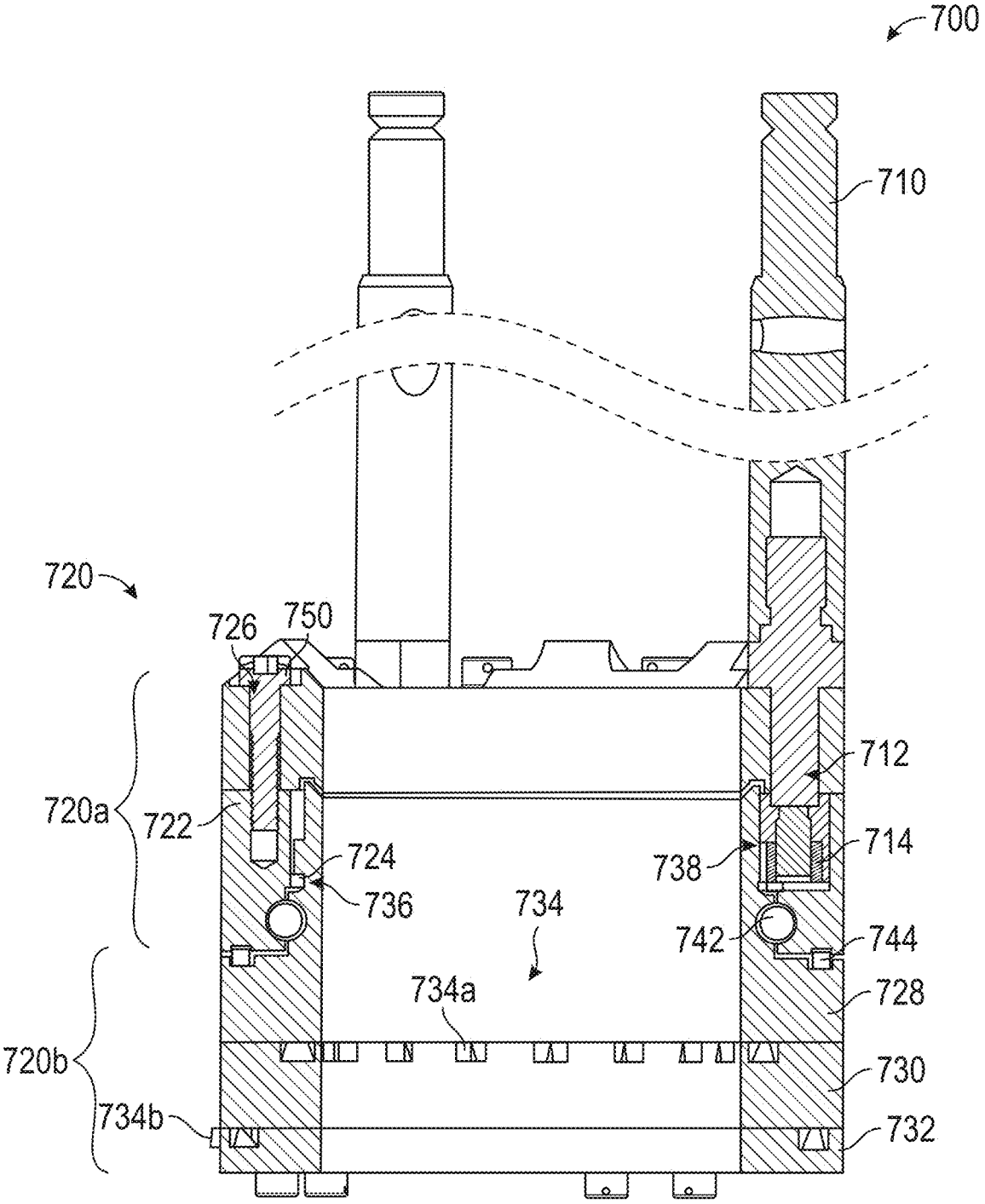

FIGS. 7A and 7B are partially schematic isometric and cross-sectional views, respectively, of a carbon removal component 700 configured in accordance with embodiments of the present technology. The carbon removal component 700 illustrated in FIGS. 7A and 7B can be generally similar (or identical) to the carbon removal component 630 discussed above with reference to FIGS. 6A and 6B. For example, as illustrated in FIG. 7A, the carbon removal component can include one or more rods 710 (three illustrated in FIG. 7A), as well as an end effector 720 (e.g., a scraper head) coupled to a distal end region 712 (FIG. 7B) of the one or more rods 710.

As best illustrated in FIG. 7B, the end effector 720 can include a first housing portion 720*a* and a second housing portion 720*b* coupled to the first housing portion 720*a*. The first housing portion 720*a* (sometimes also referred to herein as an "upper housing portion," a "fixed housing portion," and/or the like) has an annular main body 722 that includes a rail 724 and openings 726. In the illustrated embodiment, the second housing portion 720*b* (sometimes referred to herein as a "lower housing portion" a "rotatable housing portion," and/or the like) includes a first annular body 728, a second annular body 730, and a third annular body 732 each couplable together to form the second housing portion 720*b*. The separate construction can allow any of the first-third annular bodies 728-732 to be individually serviced and/or replaced, which can help reduce costs associated with using the end effector 720. In some embodiments, however, the first-third annular bodies 728-732 are formed integrally in a single annular body to help reduce sources of error in the end effector 720.

As further illustrated in FIG. 7B, the second annular body 730 (sometimes referred to herein as "tooth holder") includes inward-facing teeth 734*a* and the third annular body 732 (sometimes referred to herein as "tooth holder") includes outward-facing teeth 734*b* (referred to collectively as "teeth 734"). The teeth 734 can scrape carbon deposited and/or collecting on the walls of a reaction chamber (e.g., the internal walls 624 of FIG. 6A). Further, the first annular body 728 includes a track 736 positioned to mate with the rail 724 of the annular main body 722 when the first and second housing portions 720*a*, 720*b* are coupled together. Further, the end effector 720 can also include bearings component 742 (e.g., ball bearings and/or another suitable component) and a seal 744 positioned between the first and second housing portions 720*a*, 720*b*. The bearings component 742 allows the second housing portion 720*b* to rotate with respect to the first housing portion 720*a* (e.g., to index the teeth 734 to scrape a variety of locations within a reaction chamber). The seal 744 can help prevent contaminants (e.g., carbon particulates) from reaching the bearings component 742 while the end effector 720 scrapes carbon. The track 736 and rail 724 can help maintain the connection and/or alignment between the first and second housing portions 720*a*, 720*b* during the rotations.

In the illustrated embodiments, the rotation of the second housing portion 720*b* can be driven and/or controlled by the one or more rods 710 (one shown in the cross-section in FIG. 7B). For example, the distal end region 712 of the one or more rods 710 can include a gear 714 (e.g., a spur gear) that is coupled to a track 738 on the first annular body 728 of the second housing portion 720*b* and isolated from the first housing portion. In some embodiments, the gear 714 is coupled to the distal end region via an adapter (e.g., such that the gear 714 can be physically separated from the rod 710). In some such embodiments, the one or more rods 710 can include an internal drive shaft (not shown) coupled to the gear 714 to drive rotation of the gear 714. As a result, the one or more rods 710 can drive rotation of the second housing portion 720*b* with respect to the first housing portion 720*a* (e.g., to index the teeth 734 and/or cause the teeth 734 to scrape while rotating).

As further illustrated in FIG. 7B, the end effector 720 can further include one or more fasteners 750 (one illustrated in the cross-section of FIG. 7B) that are insertable into the openings 726 in the first housing portion 720*a*. The fasteners 750 can help couple the distal end region 712 of the one or more rods 710 to the end effector 720 (e.g., by locking a cap onto the first housing portion 720*a*) and/or can help couple sub-components of the first housing portion 720*a* together. In various embodiments, the end effector 720 can include various additional fasteners (not shown in the cross-section of FIG. 7B) to secure components of the end effector 720 together. Purely by way of example, the end effector 720 can include fasteners that help couple the first-third annular bodies 728-732 together.

Figure 8A:
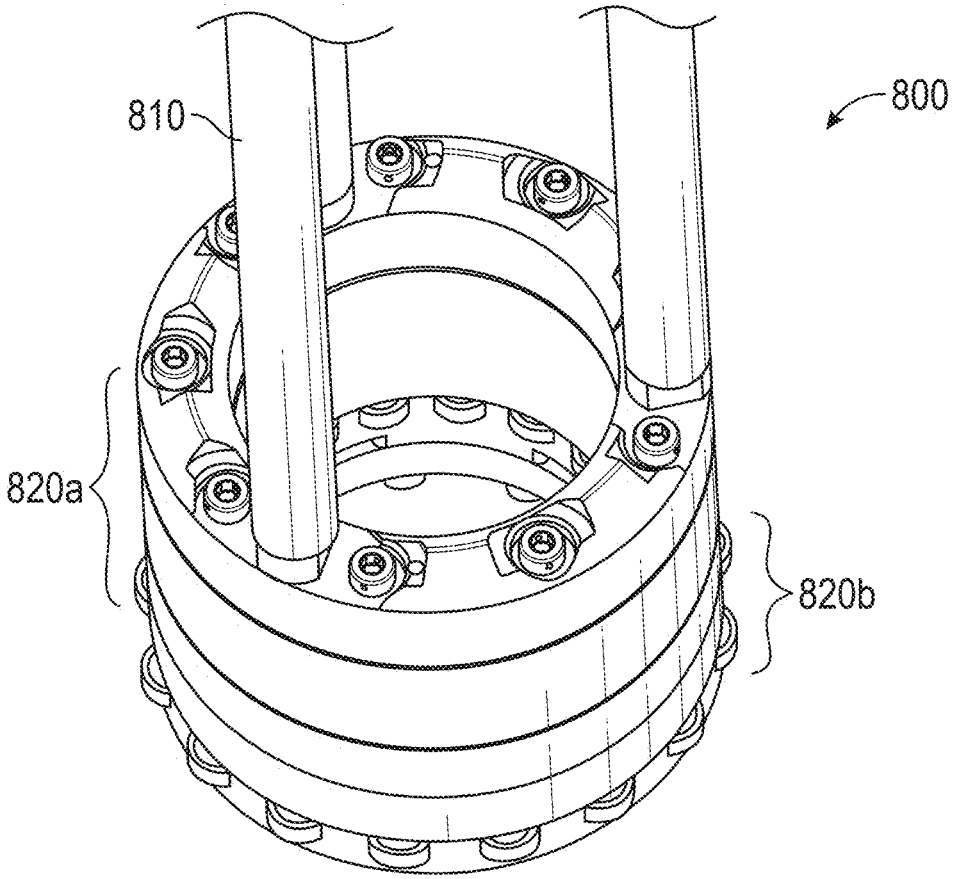
FIGS. 8A and 8B are partially schematic isometric and bottom views, respectively, of a carbon removal component configured in accordance with embodiments of the present technology.
Figure 8B:
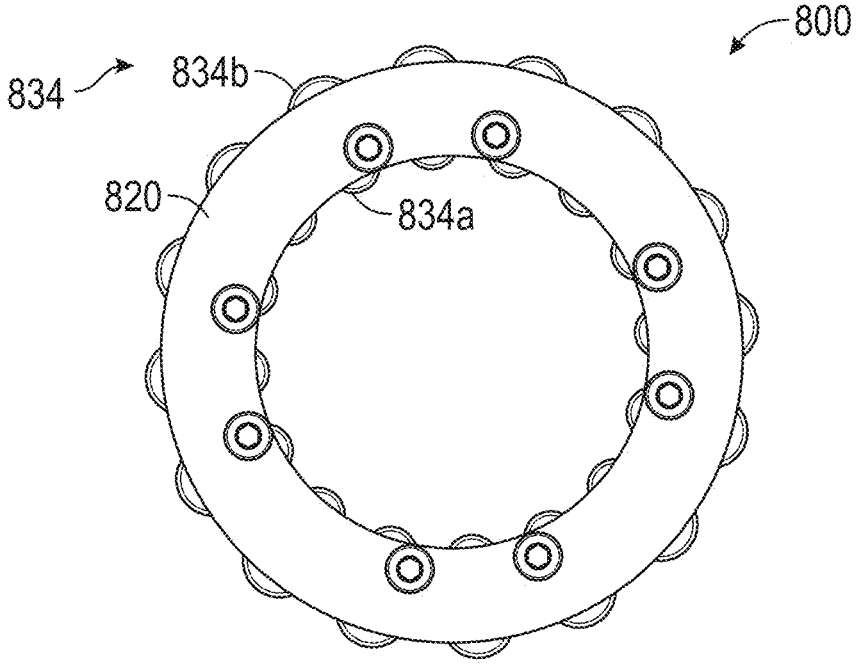

FIGS. 8A and 8B are partially schematic isometric and bottom views, respectively, of a carbon removal component 800 configured in accordance with embodiments of the present technology. As illustrated in FIGS. 8A and 8B, the carbon removal component 800 is generally similar to the carbon removal component 700 discussed above with reference to FIGS. 7A and 7B. For example, as best illustrated in FIG. 8A, the carbon removal component 800 can include one or more rods 810 (three illustrated in FIG. 8A) and an end effector 820 that includes a first housing portion 820*a* and a second housing portion 820*b*. Further, the second housing portion 820*b* can be rotatably coupled to the first housing portion 820*a* in a manner similar (or identical) to the coupling discussed above with respect to FIGS. 7A and 7B (e.g., via internal bearings, rails/tracks, and/or gears).

As best illustrated in FIG. 8B, however, the end effector 820 can include inward-facing teeth 834*a* and outward-facing teeth 834*b* (referred to collectively as "teeth 834") that have a generally rounded profile. The rounded profile is expected to increase a strength of the teeth 834 (e.g., as compared to the sharp and/or angular profile of the teeth 734 illustrated in FIGS. 7A and 7B), thereby reducing the chance that the teeth 834 break off while scraping carbon in a reaction chamber. As a result, the rounded profile is expected to increase a lifespan of the teeth 834, thereby reducing costs associated with using the end effector 820 and/or reducing downtime required to provide maintenance to the teeth 834. Additionally, or alternatively, the rounded profile of the teeth 834 can help prevent the teeth 834 from falling into (and/or being pulled into) grooves created by previous actuations. As a result, the rounded profile can help the end effector 820 clear a larger surface area of the reaction chamber.

Figure 9:
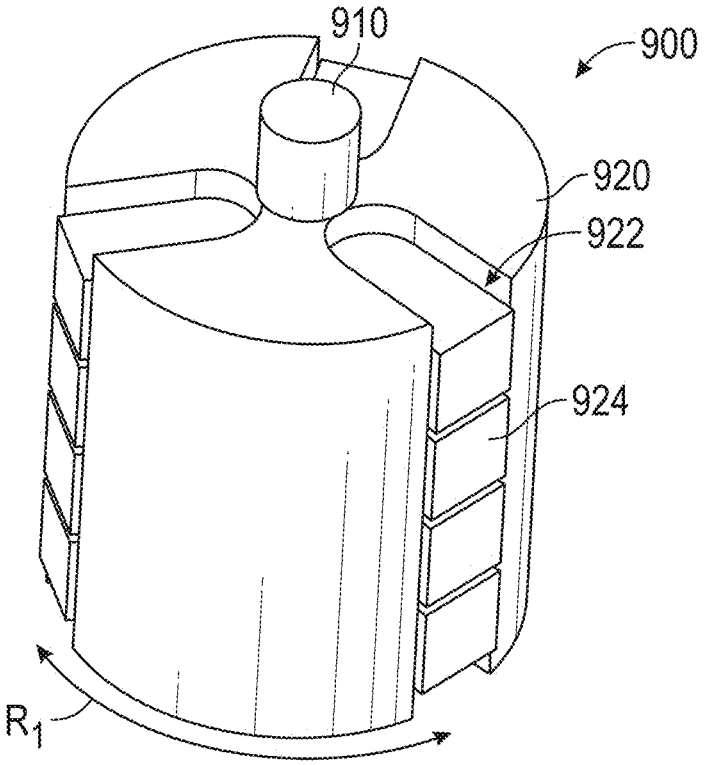
FIG. 9 is a partially schematic isometric view of a carbon removal component configured in accordance with further embodiments of the present technology.

FIG. 9 is a partially schematic isometric view of an end effector 900 for a carbon removal component configured in accordance with further embodiments of the present technology. The end effector 900 can be used in a pyrolysis reactor with a CCP chamber (e.g., the CCP chamber 210 of FIG. 2A), central reaction chamber (e.g., inverse to the pyrolysis reactor 600 of FIG. 6A), and/or separate reaction chamber (e.g., as discussed below with reference to FIGS. 13-15), referred to collectively as a reaction chamber with respect to FIGS. 9-11. As illustrated in FIG. 9, the end effector 900 can include main body 920 that is coupled (or couplable) to a rod 910. The main body includes channels 922 that can receive and hold scraping inserts 924. During operation, the rod 910 can plunge the main body 920 through a reaction chamber while rotating the main body 920 along a rotation path $R_1$. As a result, the scraping inserts 924 can scrape carbon from the walls of the chamber.

In the illustrated embodiment, the scraping inserts 924 have a square-scraping profile. However, it will be understood that the technology is not so limited. Purely by way of example, the scraping inserts 924 can have a wedged profile that can help reduce the force on a leading edge of the scraping inserts 924 to reduce the chance that the scraping inserts 924 break during a plunge. In some embodiments, the scraping inserts 924 include a tungsten carbide material with a relatively high melting point (e.g., to help ensure that the scraping inserts 924 do not warp at the relatively high temperatures within a reaction chamber). Additionally, or alternatively, the scraping inserts 924 can include tungsten, molybdenum, cubic boron nitride (CBN), cobalt, polycrystalline diamond (PCD), diamond-like carbon, high-speed steel, micrograin tungsten carbide, silicon nitride, silicon carbide, tantalum carbide, various ceramics and/or ceramets, cemented carbides, superalloys, steel, titanium carbide, and/or other suitable materials In some embodiments, the rod 910 can rotate the main body 920 at a speed between about 400 rotations per minute (RPM) and about 4000 RPM, at a speed of about 500 RPM, at a speed of about 1800 RPM, and/or at a speed of about 3600 RPM. The higher rotational speeds can increase the force delivered by the scraping inserts 924 to dislodge carbon from the reaction chamber. The slower rotational speeds can decrease a chance that the scraping inserts 924 break during a plunge. In some embodiments, the end effector 900 can continuously plunge into (and out of) the reaction chamber. In some embodiments, the end effector 900 can plunge periodically into (and out of) the reaction chamber (e.g., every 1-5 minutes). In some embodiments, the end effector 900 changes the direction of the rotation along the rotational motion path $R_1$ during and/or between plunges. The change in direction can help ensure that the scraping inserts wear more evenly over time and/or help disrupt the formation of grooves in carbon deposits that can prevent complete scraping of the walls of the reaction chamber.

Figure 10:
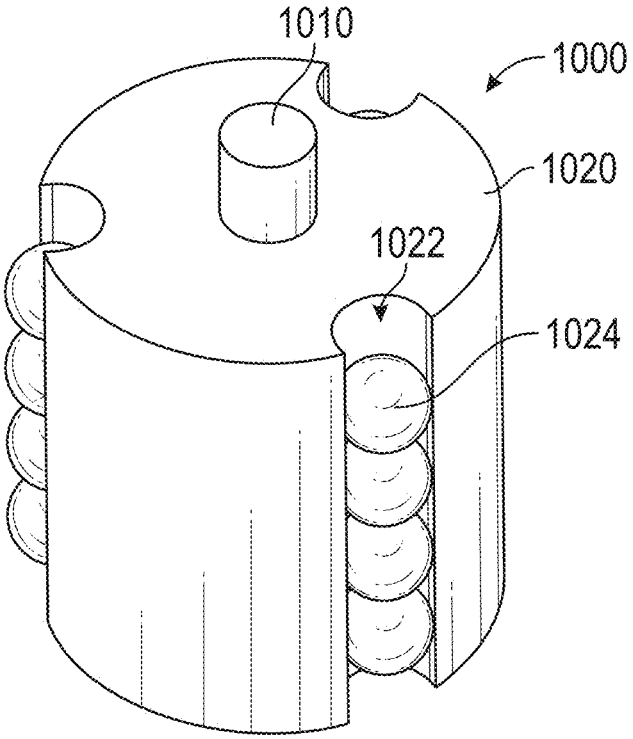
FIG. 10 is a partially schematic isometric view of a carbon removal component configured in accordance with further embodiments of the present technology.

FIG. 10 is a partially schematic isometric view of an end effector 1000 for a carbon configured in accordance with further embodiments of the present technology. As illustrated in FIG. 10, the end effector 1000 is generally similar to the end effector 900 discussed above with reference to FIG. 9. For example, the end effector 1000 includes a main body 1020 that is couplable (or coupled) to a rod 1010. Further, the main body includes channels 1022 that receive and hold scraping inserts 1024. Similar to the discussion above, the rod 1010 can actuate (e.g., rotate and plunge) the main body into (and out of) a reaction chamber, allowing the scraping inserts 1024 to scrape carbon from the walls of the reaction chamber. In the illustrated embodiment, however, the scraping inserts 1024 have a spherical profile that can help reduce a force of the carbon deposits against the scraping inserts 1024 during operation. As a result, for example, the rod 1010 can rotate the main body 1020 at higher rotational speeds (e.g., at about 3600 RPM) with a smaller chance that the scraping inserts 1024 break as compared to the scraping inserts 924 of FIG. 9.

Figure 11:
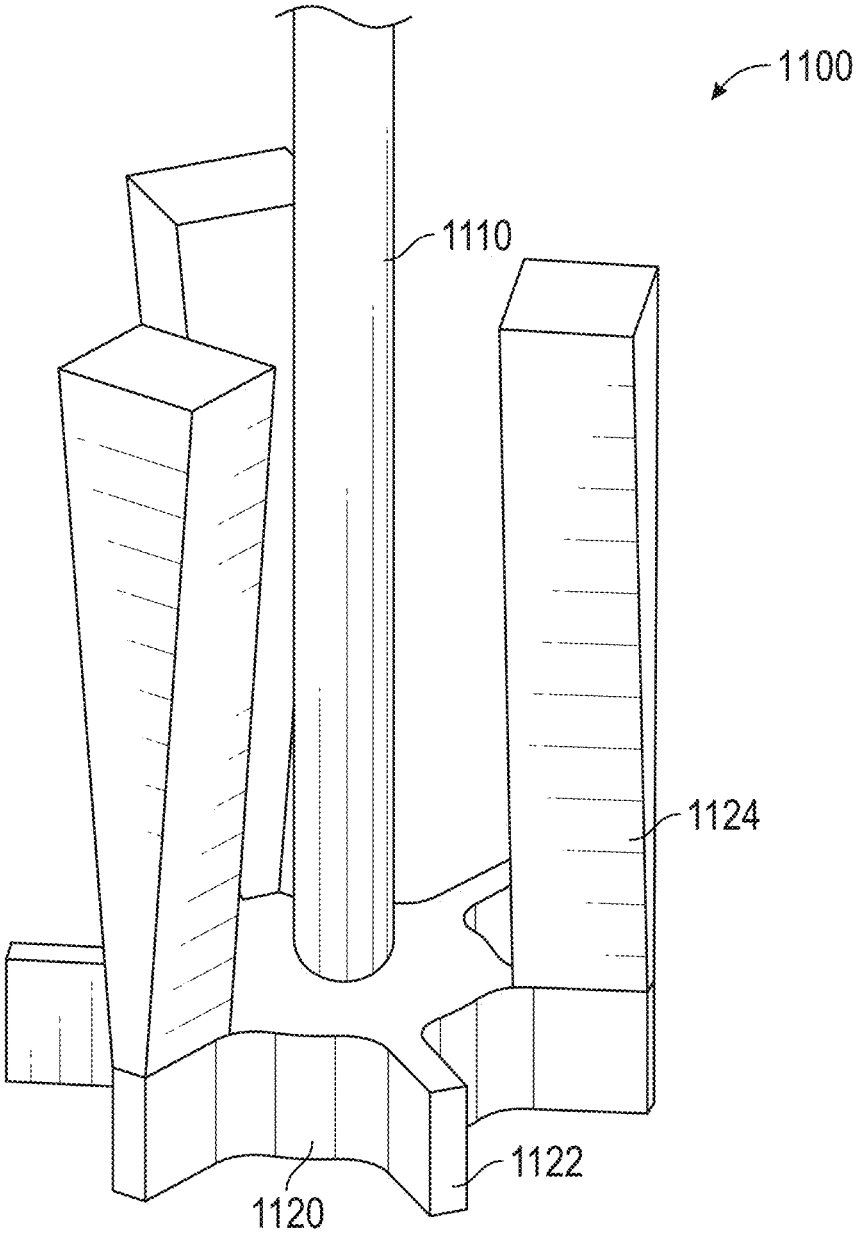
FIG. 11 is a partially schematic isometric view of a carbon removal component configured in accordance with further embodiments of the present technology.

FIG. 11 is a partially schematic isometric view of an end effector 1100 for a carbon removal component configured in accordance with further embodiments of the present technology. As illustrated in FIG. 11, the end effector 1100 can include a main body 1120 that is coupled (or couplable) to a rod 1110. Further, the main body 1120 includes one or more slot cutters 1122 (six illustrated in FIG. 11) and one or more wedge cutters 1124 (three illustrated in FIG. 11) each carried by a corresponding one of the slot cutters 1122. During operation, the rod 1110 can plunge the main body 1120 through a reaction chamber. As a result, the slot cutters 1122 can scrape carbon deposits in the reaction chamber to create relatively narrow slots in the carbon deposits. Further, each of the slot cutters 1122 can have a relatively small width, thereby reducing the force needed to create the slots in the carbon deposits and/or reducing the force push-back on the slot cutters 1122 from compression in the carbon deposits. As the end effector 1100 is plunged deeper into the reaction chamber, the wedge cutters 1124 each enter one of the slots from the slot cutters 1122 and start to create a shear force between the slots. The carbon deposits are expected to be weaker in shear than in compression, allowing the wedge cutters 1124 to create a shear plane between slots that dislodges a relatively large amount of carbon with less force than if the carbon was scraped along a compressive direction. Said another way, the slot-and-wedge design of the end effector 1100 is expected to reduce the scraping force required to remove carbon from the reaction chamber by creating sheer planes between adjacent slots.

Figure 12:
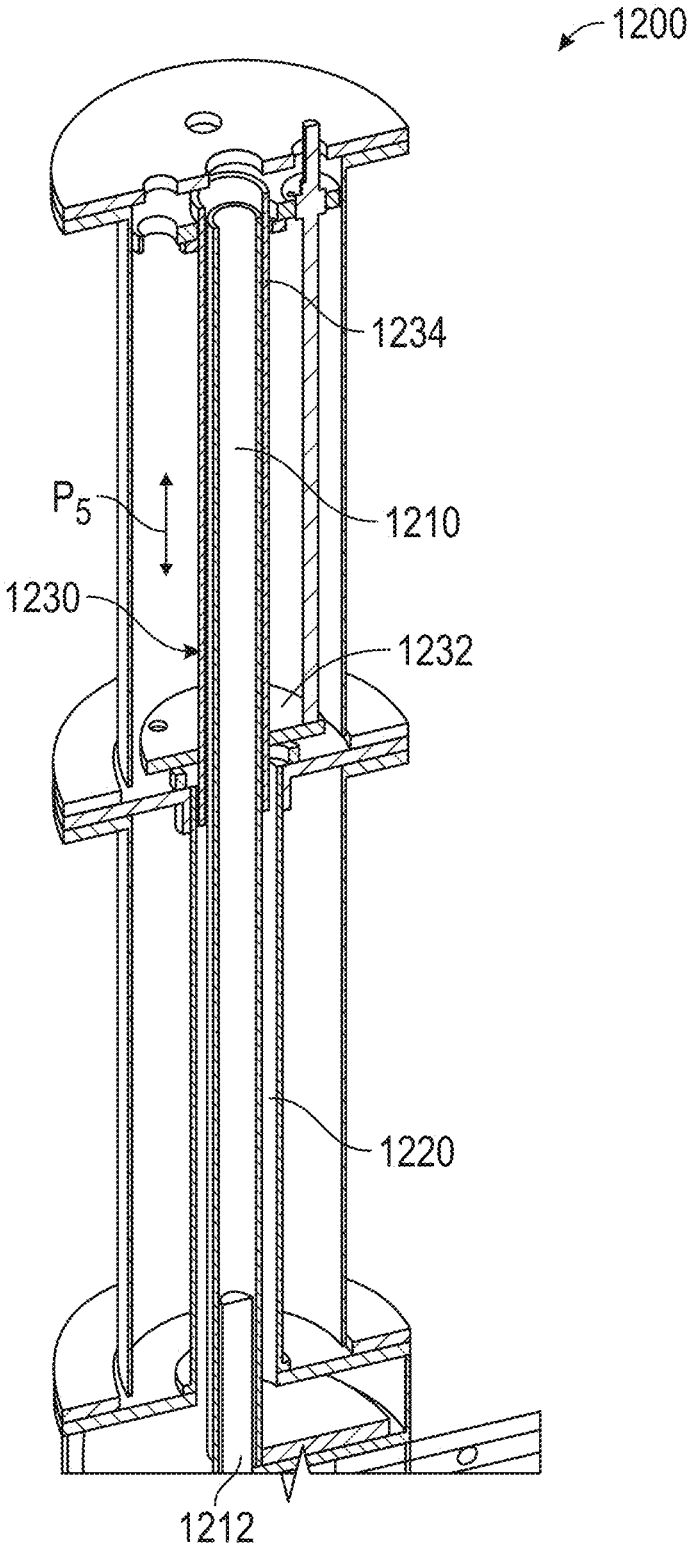
FIG. 12 is a partially schematic isometric cross-sectional view of a pyrolysis reactor configured in accordance with further embodiments of the present technology.

FIG. 12 is a partially schematic isometric view of a pyrolysis reactor 1200 configured in accordance with further embodiments of the present technology. In the illustrated embodiment, the pyrolysis reactor 1200 has an annular arrangement generally similar to the pyrolysis reactor 600 discussed above with reference to FIGS. 6A and 6B. For example, the pyrolysis reactor 1200 includes a combustion chamber 1210 coupled to a combustion component 1212 and a reaction chamber 1220 positioned annularly around the combustion chamber 1210. Further, the pyrolysis reactor 1200 includes a carbon removal component 1230 that is operable to scrape carbon out of the reaction chamber 1220.

In the illustrated embodiment, however, the carbon removal component 1230 includes a support component 1232 a plunging tube 1234 positioned to move along a motion path $P_5$, with support from the support component 1232 (e.g., a second strongback), into and out of the reaction chamber 1220. The plunging tube 1234 can include one or more scraping components (e.g., teeth) positioned along a length of the plunging tube 1234 and/or at a distal end of the plunging tube 1234. As a result, the plunging tube 1234 can avoid having any moving parts on the scraping system, which can help simplify the operation of the carbon removal component 1230 and/or increase the lifespan of the carbon removal component 1230 by reducing possible sources of error.

Further, in some embodiments, the plunging tube 1234 can rotate about a rotational axis $R_1$ while moving along the motion path $P_5$ into and out of the reaction chamber 1220. For example, as discussed in more detail below with reference to FIGS. 17A-17E, the scraping components can be sloped to drive the rotation of the plunging tube 1234. Additionally, or alternatively, the plunging tube 1234 can be coupled to one or more actuators (e.g., the actuator 340 of FIG. 3) that drive both linear motion along the motion path $P_5$ and rotation about the rotational axis $R_1$.

Figure 14:
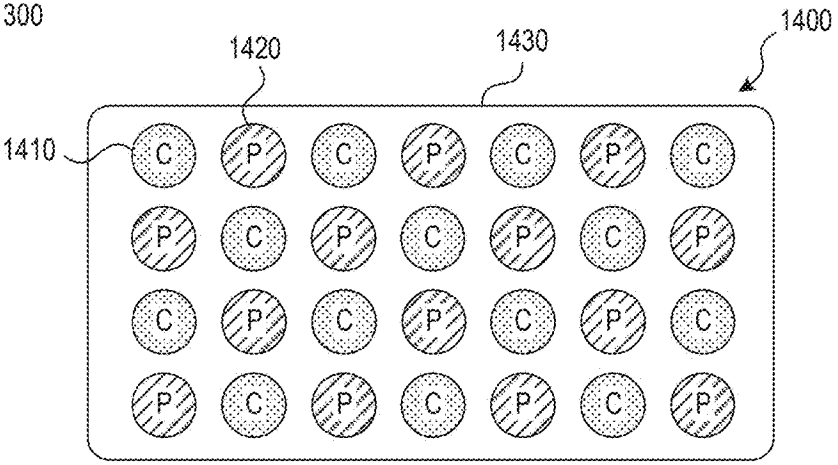
FIGS. 13-15 are partially schematic top views of multi-chamber pyrolysis reactors configured in accordance with embodiments of the present technology.
Figure 13:
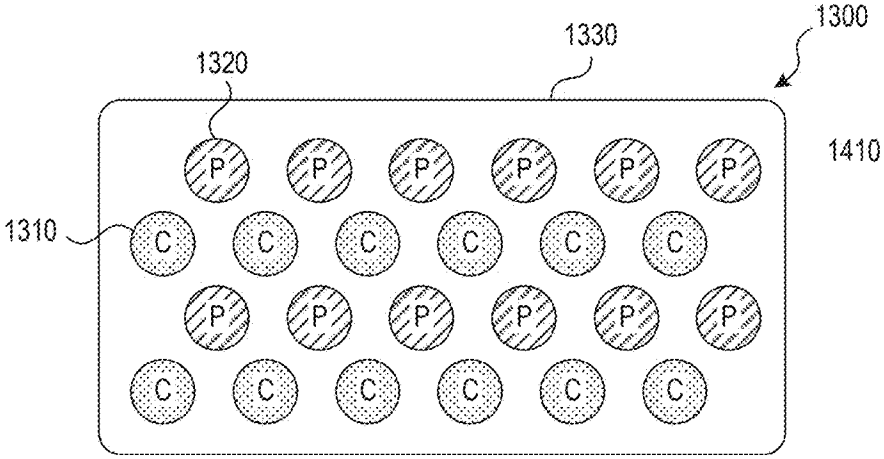
Figure 15:
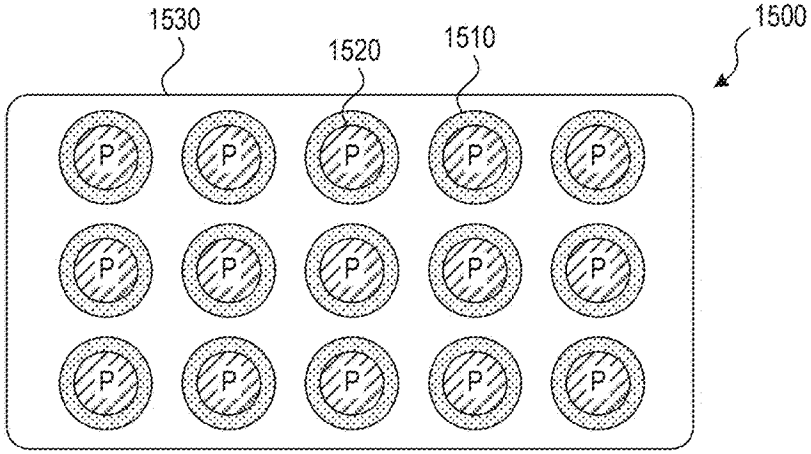

Examples of Suitable Multi-Chamber Reactor Systems in Accordance with Embodiments of the Present Technology In some embodiments, a pyrolysis system can include an array of adjacent, nested, and/or combined reaction and combustion chambers that provide additional passageways for a pyrolysis reaction to occur. In various such embodiments, the pyrolysis reactor includes alternating pyrolysis and combustion tubes in any number of geometries, unit cell arrangements, and/or unit cell configurations provided that enough heat is transferred from combustion to pyrolysis. FIGS. 13, 14, and 15 are partially schematic top views of multi-chamber pyrolysis reactors 1300, 1400, and 1500, respectively, configured in accordance with various such embodiments of the present technology.

For example, in the embodiments illustrated in FIG. 13, the pyrolysis reactor 1300 includes alternating rows of combustion chambers 1310 and reaction chambers 1320, thermally coupled by a thermal body 1330. In some embodiments, the thermal body 1330 includes an insulation material with heat paths between the combustion chambers 1310 and the reaction chambers 1320 to reduce the heat lost to a surrounding environment while establishing thermal pathways between the combustion chamber 1310 and pyrolysis fuel within the reaction chambers 1320.

In the embodiments illustrated in FIG. 14, the pyrolysis reactor 1400 includes rows alternating between combustion chambers 1410 and reaction chambers 1420 that are thermally coupled by a thermal body 1430. Similar to the discussion above, the thermal body 1430 can include an insulation material with heat paths between the combustion chambers 1410 and the reaction chambers 1420.

In the embodiments illustrated in FIG. 15, the pyrolysis reactor 1500 includes rows of annular combustion chambers 1510 and reaction chambers 1520 that are surrounded by a thermal body 1530. In such embodiments, the thermal body 1530 can include an insulation material that helps reduce heat lost from any individual annular set to a surrounding environment.

In any of the embodiments of FIGS. 13-15, the pyrolysis reactor can further include a carbon removal component that includes multiple sets of a rod and end effector to remove carbon deposits from each of the reaction chambers in the pyrolysis reactor. For example, the carbon removal component can include a crankshaft (e.g., with a motor or another suitable actuator) that is operatively coupled to the rods such that an array of the actuator rods moves up and down as the crankshaft rotates. In such embodiments, each of the reaction chambers can be cleaned out via a corresponding set of the rod/end effectors.

Figure 16:
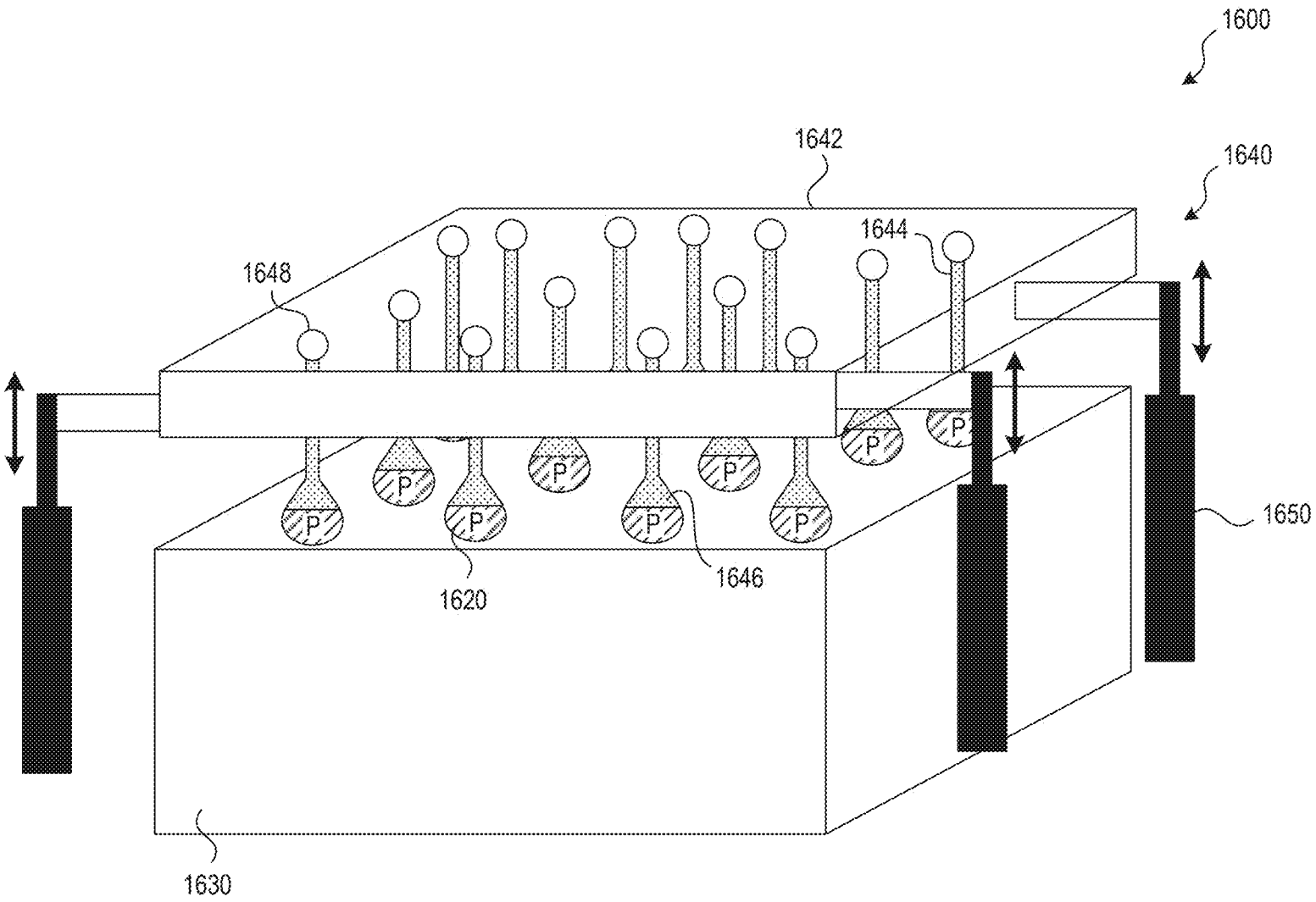
FIG. 16 is a schematic isometric view of a multi-chamber pyrolysis reactor configured in accordance with embodiments of the present technology.

In another example, the carbon removal component can include one or more actuators coupled to a strongback component. The "strongback" can be a stiff piece of metal or other suitable component that links the motion of multiple rods together. Each of the one or more rods coupled to the strongback then follows the vertical (or other) motion of the strongback. As they move, each rod can drive the actuation of a corresponding end effector within a corresponding reaction chamber to scrape or otherwise dislodge carbon from the reaction chamber. FIG. 16 is a schematic isometric view of a multi-chamber pyrolysis reactor 1600 configured in accordance with some such embodiments of the present technology.

In the illustrated embodiments, the pyrolysis reactor 1600 is generally similar to the pyrolysis reactor 1300 discussed above with reference to FIG. 13. For example, the pyrolysis reactor 1600 includes rows of reaction chambers 1620 that are surrounded by a thermal material 1630. Further, the pyrolysis reactor 1600 includes a carbon removal component 1640 to help remove carbon from each of the reaction chambers 1620. In the illustrated embodiments, the carbon removal component 1640 includes a strongback 1642, a plurality of rods 1644 each operably coupled to the strongback 1642, and a plurality of end effectors 1646 each individually coupled to a corresponding one of the rods 1644. The end effectors 1646 can be generally similar (or identical) to any of the end effectors discussed above with reference to FIGS. 2A-11, but are illustrated schematically to avoid obscuring other details of the present technology.

As further illustrated in FIG. 16, the strongback 1642 can be coupled to one or more actuators 1650 (four illustrated in FIG. 16). The actuators 1650 can drive linear motion of the strongback 1642 to plunge the rods 1644 (and the end effectors 1646 thereon) through the reaction chambers 1620 to scrape carbon buildups therein. Additionally, in some embodiments, the actuators 1650 are coupled to clocking mechanisms 1648 (e.g., gears, belts, and/or any other suitable components) to rotate the rods 1644 (and the end effectors 1646 thereon) between and/or during plunges. As a result, the actuators 1650 can help the end effectors 1646 scrape a larger portion of the internal walls of the reaction chambers 1620 to help maintain a flow path therethrough.

Figure 17A:
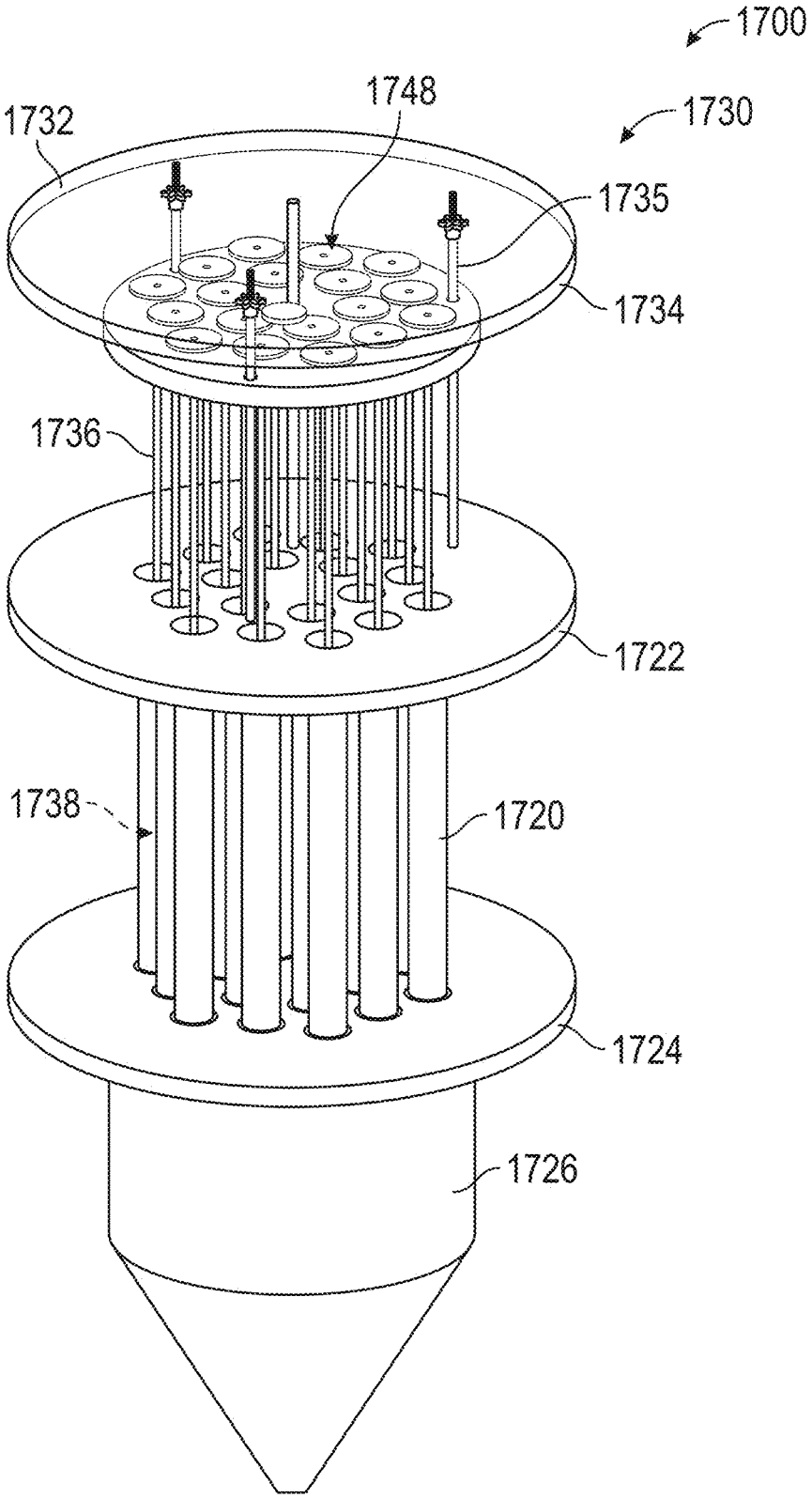
FIGS. 17A-17E are partially schematic illustrations of various aspects of a carbon removal component for a multi-chamber pyrolysis reactor in accordance with embodiments of the present technology.

FIGS. 17A-17E are partially schematic illustrations of various aspects of a carbon removal component 1730 for a multi-chamber pyrolysis reactor 1700 in accordance with embodiments of the present technology. In the illustrated embodiments, the pyrolysis reactor 1700 is generally similar to the pyrolysis reactors discussed above with reference to FIGS. 13-16. For example, as illustrated in FIG. 17A, the pyrolysis reactor 1700 can include a plurality of reaction chambers 1720 each providing a flow path for pyrolysis reaction fuel and a corresponding pyrolysis reaction. In some embodiments, one or more of the reaction chambers 1720 can be a CCP chamber providing a flow path for both the pyrolysis fuel and a combustion flue gas to provide heat to the pyrolysis reactions (including to adjacent reaction chambers). In some embodiments, the reaction chambers 1720 are at least partially heated by another heat source (e.g., dedicated combustion chambers, electric heating components, molten salt chambers, plasma chambers, and/or the like). In the illustrated embodiment, each of the chambers extends from a first mounting plate 1722 to a second mounting plate 1724 and directs an output flow (e.g., a product stream) into an outlet cone 1726.

As further illustrated in FIG. 17A, the pyrolysis reactor 1700 can also include a carbon removal component 1730 to help remove carbon buildup in each of the reaction chambers 1720. For example, the carbon removal component 1730 can be carried by a third plate 1732 generally aligned with the first and second mounting plates 1722, 1724. Further, the carbon removal component 1730 can include a strongback 1734, a plurality of rods 1736 carried by the strongback 1734, and a plurality of end effectors 1738 each carried by a corresponding one of the rods 1736. Further, the strongback 1734 is coupled to the third plate 1732 by actuating components 1735 and includes a gear system 1748 coupled to each of the plurality of rods 1736.

Figure 17C:
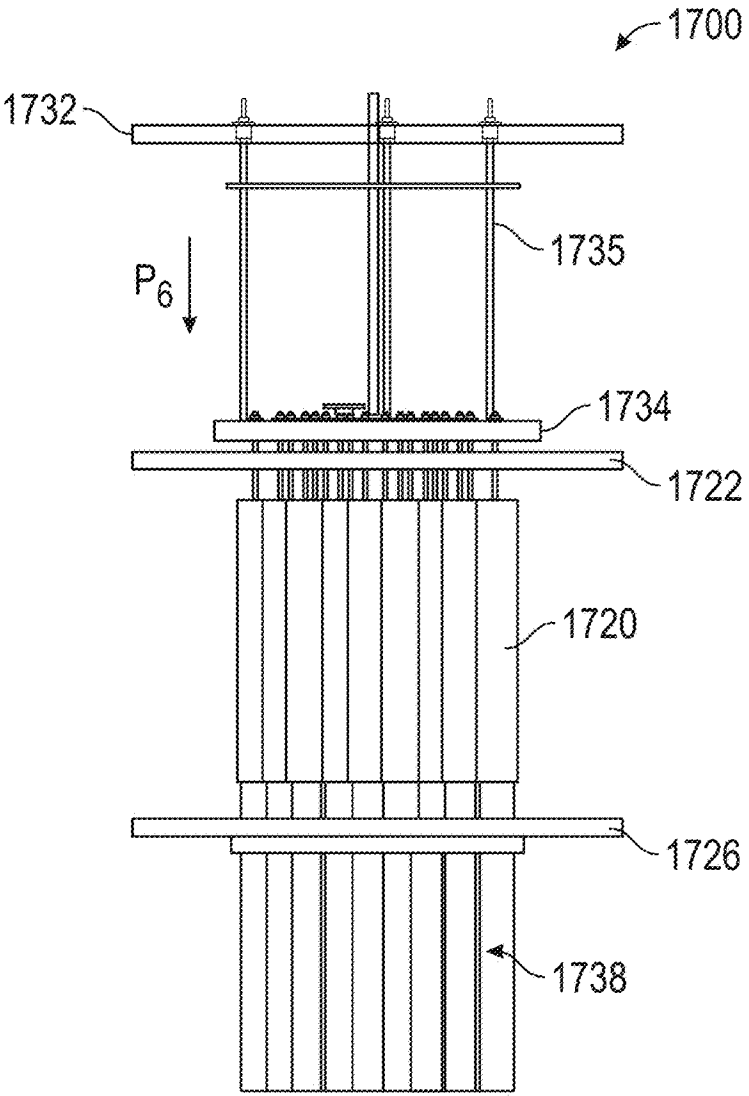
Figure 17B:
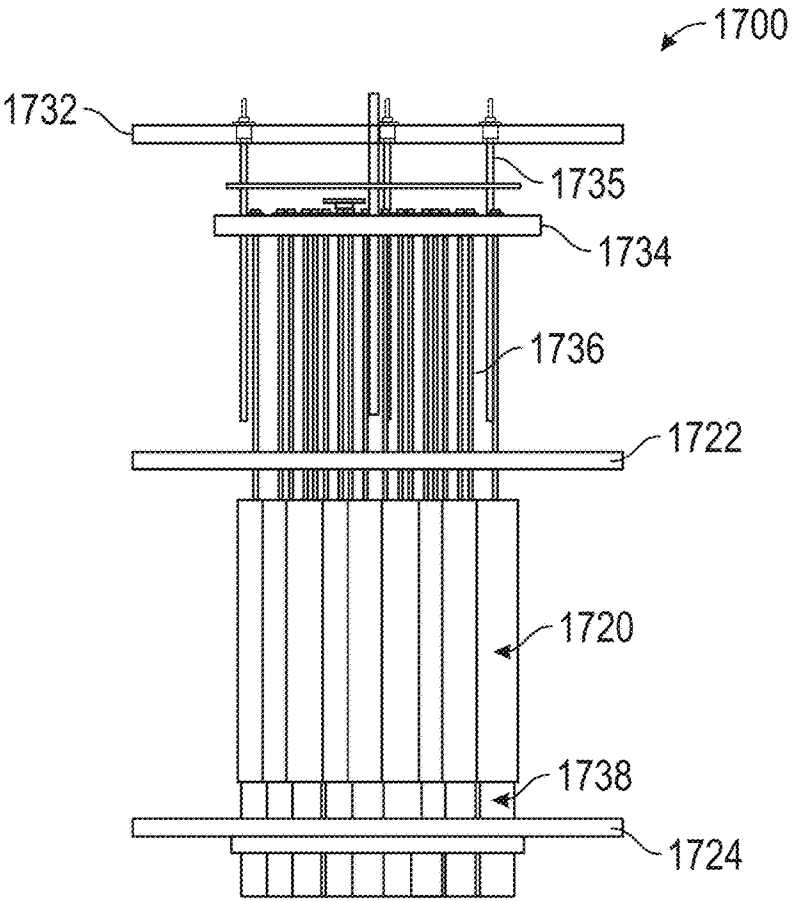

As best illustrated in FIGS. 17B and 17C, the actuating components 1735 can extend (or expand) and retract (or contract) to move the strongback 1734 in a vertical direction along path $P_6$ (FIG. 17C). For example, the actuating components 1735 can include ball screw components that move up and down a screw shaft to move the strongback 1734 along the path $P_6$. In turn, the movement plunges the rods 1736, and the end effectors 1738 carried thereby, into and through the reaction chambers 1720, allowing the end effectors 1738 to scrape carbon from internal walls of the reaction chambers 1720. In various embodiments, the actuating components 1735 can include pneumatic actuators, hydraulic components, mechanically driven rails, electrically driven rails, and/or the like. In some embodiments, the rods 1736 are combined with the actuating components 1735. For example, the strongback 1734 (or the third plate 1732) can provide a stable backing while each of the rods 1736 includes an expandable component (e.g., a telescoping component, a hydraulic component, extendible rails, and/or any other suitable component). In some such embodiments, the rods 1736 can be independently actuated (e.g., in response to carbon buildup in the reaction chambers 1720).

Figure 17E:
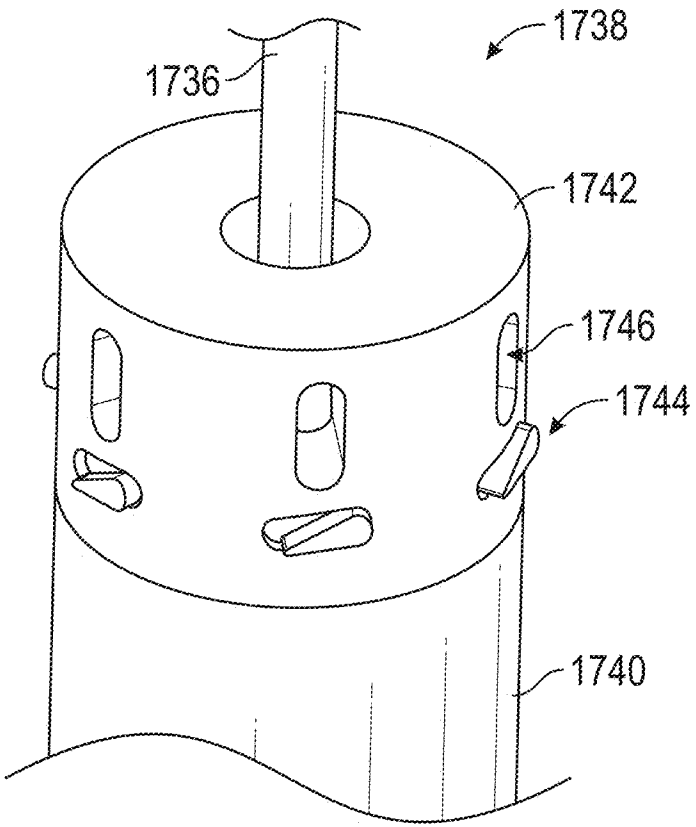
Figure 17D:
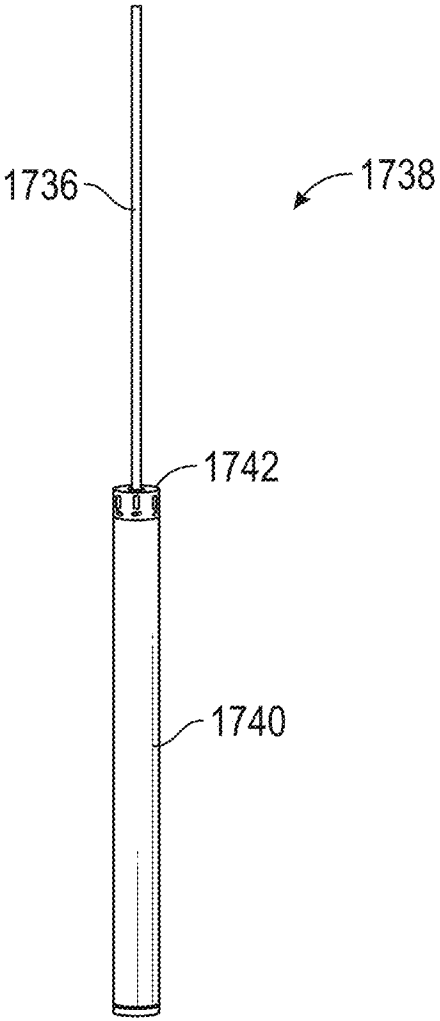

As best illustrated in FIGS. 17D and 17E, each of the end effectors 1738 can include a main body 1740 and a trimmer head 1742. As illustrated, the main body 1740 can have an elongated profile, which can help stabilize the end effector 1738 within one of the reaction chambers 1720 (FIG. 17A). In some embodiments, the main body 1740 can include a silicon carbide material that can withstand relatively high temperatures within the reaction chambers 1720. The trimmer head 1742 can include scraping components 1744. The scraping components 1744 can be generally similar to any of the scraping components discussed above. In the illustrated embodiment, the scraping components 1744 have a wedge-shaped profile that is sloped such that a downward plunge of the end effector 1738 can result in the carbon buildup generating rotational forces on the end effector 1738. The rotational forces, in turn, can help drive rotation of the end effector 1738 (and the trimmer head 1742 thereon) during a plunge, allowing the end effector 1738 to scrape an entire circumference of one of the reaction chambers 1720 (FIG. 17A) during each plunge. Further, the gear system 1748 (FIG. 17A) can help rotate the rods 1736 during a plunge. For example, the gear system 1748 can be coupled to an actuation system to help drive the rotation. In another example, the gear system 1748 can link the rotation of each of the rods 1736 (and the end effectors 1738 thereon) to use rotational forces from one or more end effectors 1738 to drive rotation of one or more other end effectors 1738.

As further illustrated in FIG. 17E, the trimmer head 1742 can also include openings 1746 that can hold an optional graphite and/or hexagonal boron nitride (hBN) brush (not shown). The brush, when included, can provide an extra component to scrape and/or otherwise remove carbon from the internal walls of the reaction chambers 1720 (FIG. 17A) as the end effector 1738 is actuated.

It will be understood that while a particular embodiment of the end effectors 1738 is illustrated and discussed with reference to FIGS. 17A-17E, the technology disclosed herein is not so limited. In various other embodiments, for example, the pyrolysis reactor 1700 can include an end effector that is generally similar (or identical) to any of the end effectors discussed above with reference to FIGS. 2A-11. It will also be understood that, in some embodiments, the end effector 1738 can be combined with the plunging tube 1234 discussed above with reference to FIG. 12 to omit the rods 1736 from the carbon removal component 1730.

Figure 18:
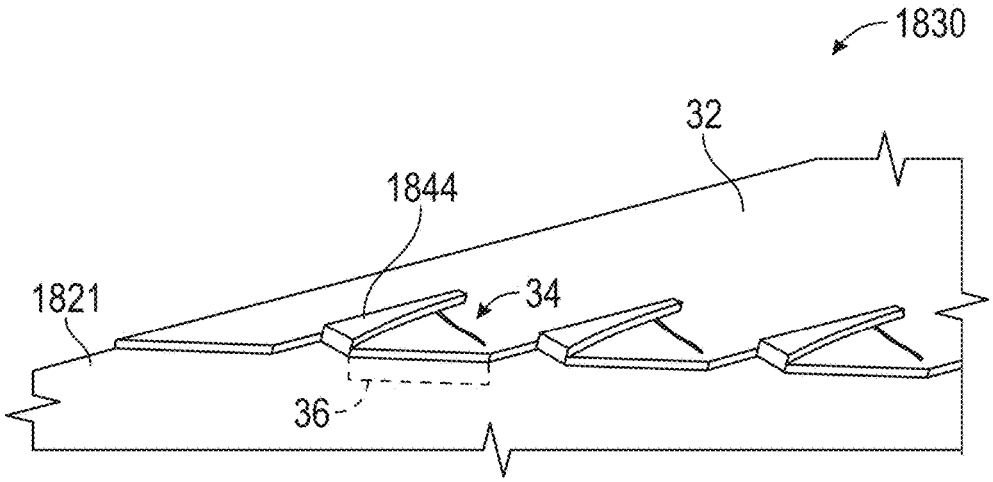
FIG. 18 is a partially schematic illustration of a wedge component of a carbon removal component in accordance with embodiments of the present technology.

FIG. 18 is a partially schematic illustration of wedge components 1844 of a carbon removal component 1830 during operation in accordance with embodiments of the present technology. In the illustrated embodiment. The wedge components 1844 can be generally similar (or identical) to the scraping components 1744 discussed above with reference to FIGS. 17D and 17E. As illustrated in FIG. 18, the wedge components 1844 can help scrape carbon 32 from an internal wall 1821 of a reaction chamber (e.g., the internal walls of the reaction chambers 1720 of FIG. 17A). More specifically, similar to the discussion above with reference to FIG. 11, the wedge components 1844 can create a shear force in the carbon 32, resulting in propagation of cracks 34 that dislodge chunks 36 of the carbon 32 at a time. Similar to the discussion above, because the wedge components cause the cracks 34 to propagate based on sheer forces (rather than compression scraping), the wedge components 1844 can help dislodge the chucks 36 with less force than if the carbon removal component 1830 relied on compression scraping. Additionally, the chunks 36 can remove carbon from a larger surface area of the internal wall 1821 than the wedge components 1844 can scrape directly. As a result, the wedge components 1844 can help scrape the internal wall 1821 more completely.

Figure 19:
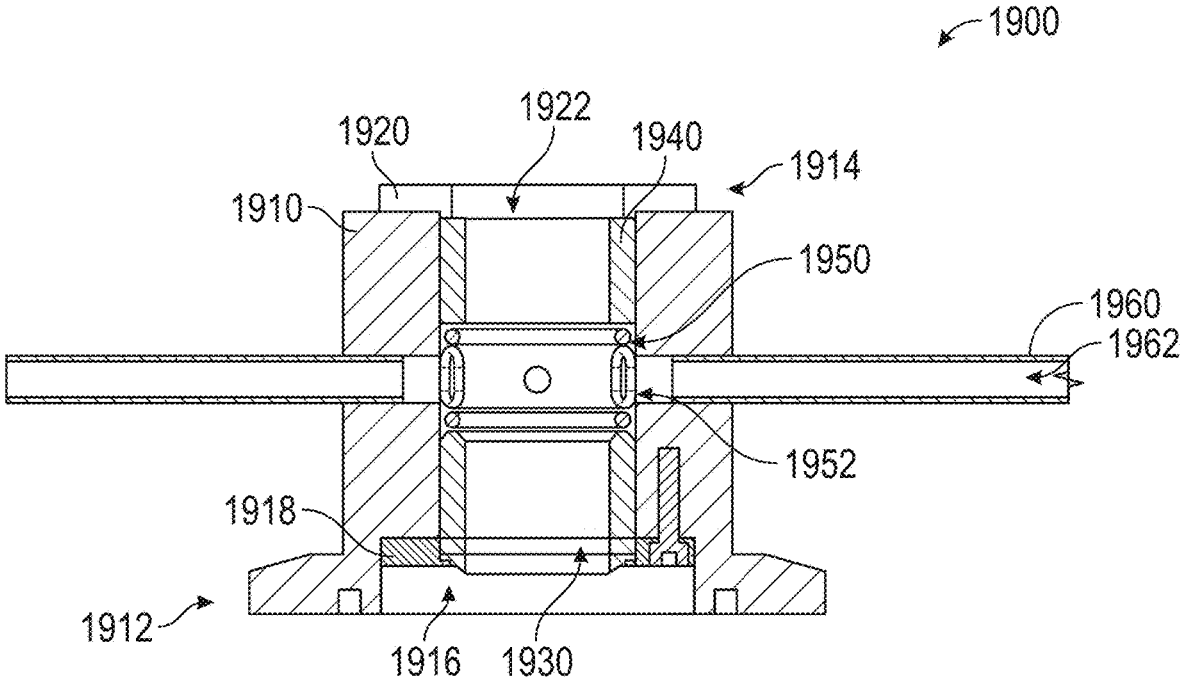
FIG. 19 is a partially schematic cross-sectional illustration of a sealing device configured in accordance with embodiments of the present technology.

Examples of Suitable Sealing Devices for Reactor Systems in Accordance with Embodiments of the Present Technology FIG. 19 is a partially schematic cross-sectional illustration of a sealing device 1900 configured in accordance with embodiments of the present technology. The sealing device 1900 of FIG. 19 can be implemented into any of the carbon removal components discussed above to help prevent process gasses (e.g., pyrolysis fuel, combustion fuel, flue gas, hydrogen gas, byproduct gasses, and/or the like) from leaking out of a reaction chamber. In the illustrated embodiments, the sealing device 1900 includes a seal housing 1910 extending from a first end region 1912 (e.g., a reaction chamber-facing region) to a second end region 1914 (e.g., an external-facing region).

The sealing device 1900 also includes a scraping component 1916 and a retaining component 1918 each carried by the first end region 1912. The scraping component 1916 can scrape carbon and/or other buildup off of a rod (e.g., any of the rods discussed above) and/or another suitable component moving through an opening 1930 at the first end region 1912. As a result, the scraping component 1916 can help prevent carbon (or other particulates) from entering the sealing device 1900, where they could undermine the quality of the sealing device 1900 (e.g., causing leaks and/or requiring maintenance). The retaining component 1918 can help retain the scraping component 1916 at the first end region 1912 while allowing the scraping component 1916 to be periodically replaced to service the sealing device 1900. The sealing device 1900 also includes a retaining component 1920 with an opening 1922 at the second end region 1914. The retaining component 1920 can help retain each of the components of the sealing device 1900 together and/or attach the sealing device to an end region of a corresponding reaction chamber. The opening 1922 provides room for a rod and/or other suitable component to move through the sealing device 1900.

As further illustrated in FIG. 19, the sealing device 1900 can also include a sleeve bearing 1940, a seal component 1950, and a lantern ring 1952 positioned between the first and second distal end regions 1912, 1914. The sleeve bearing 1940 can allow the rod (or other suitable component) to rotate within the seal without degrading the quality of the sealing device 1900. The seal component 1950 can provide a gas-tight barrier between the first end region 1912 and the second end region 1914 to prevent the process gasses from moving therebetween. The lantern ring 1952 can help provide support to the seal component 1950, allowing the sealing device 1900 to be pressurized to help maintain a seal between the first end region 1912 and the second end region 1914. For example, the sealing device 1900 can include one or more gas inlets 1960 (two illustrated in FIG. 19) that each provides a pressurized path 1962 to the seal component 1950 to pressurize the sealing device. By maintaining a pressure in the seal component 1950 above a pressure in the reaction chamber, the sealing device 1900 can help ensure that process gasses never leak from the first end region 1912 and the second end region 1914.

Figure 20A:
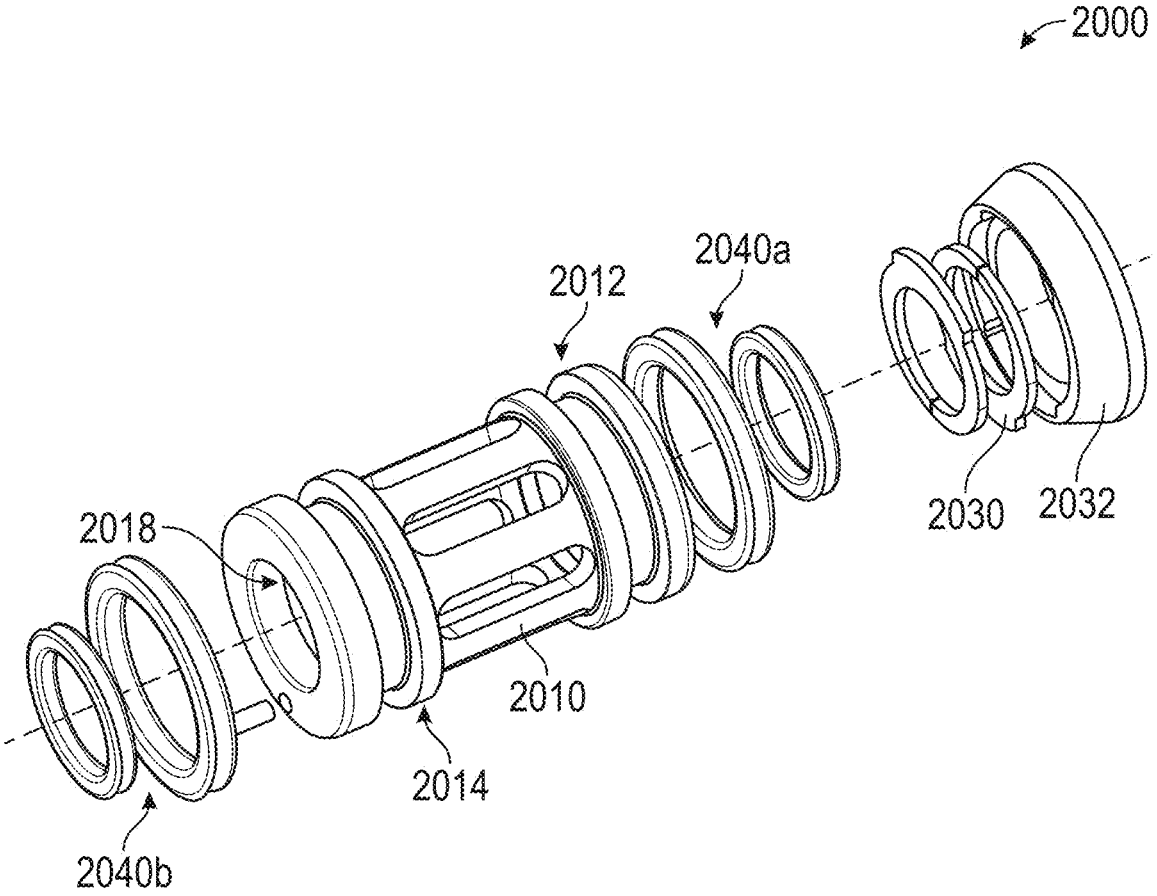
FIGS. 20A and 20B are partially schematic exploded and cross-sectional views, respectively, of a sealing device configured in accordance with embodiments of the present technology.
Figure 20B:
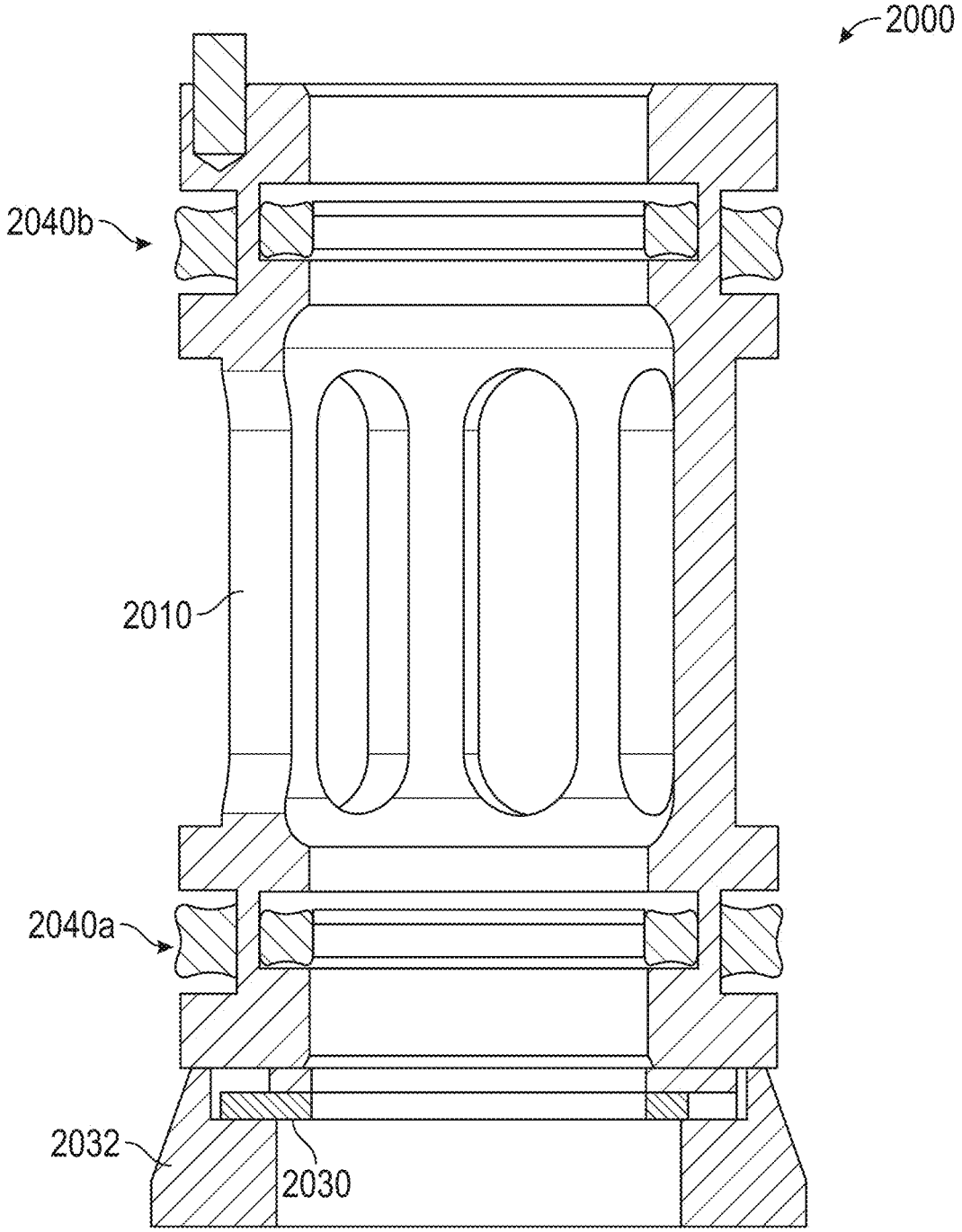
Figure 21:
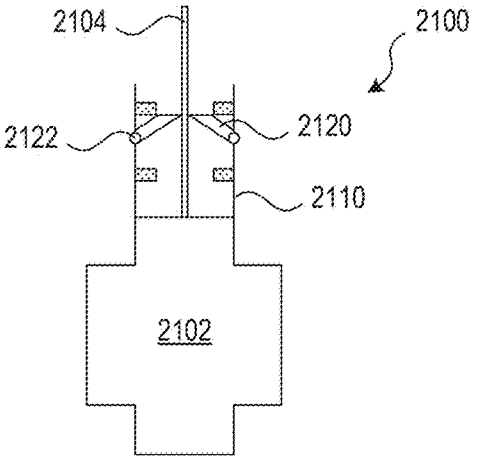
FIGS. 21-29 are schematic cross-sectional views of sealing devices configured in accordance with further embodiments of the present technology.

FIGS. 20A and 20B are partially schematic exploded and cross-sectional views, respectively, of a sealing device 2000 configured in accordance with embodiments of the present technology. Similar to the discussion above, the sealing device 2000 of FIGS. 20A and 20B can be implemented into any of the carbon removal components discussed above to help prevent process gasses (e.g., pyrolysis fuel, combustion fuel, flue gas, hydrogen gas, byproduct gasses, and/or the like) from leaking out of a reaction chamber. Further, the sealing device 2000 of FIGS. 20A and 20B is generally similar to the sealing device 1900 discussed above with reference to FIG. 19. For example, the sealing device includes a seal housing 2010 extending from a first end region 2012 to a second end region 2014. In the illustrated embodiments, the seal housing 2010 is shaped to provide a lantern ring, double spring seal to the reaction chamber. For example, the sealing device 2000 includes a first set of x-profile rings 2040*a* that mate with external and internal surfaces of the seal housing 2010 at the first end region 2012, as well as a second set of x-profile rings 2040*b* that mate with external and internal surfaces of the seal housing 2010 at the second end region 2014. Each of the first and second sets of x-profile rings 2040*a*, 2040*b* provides a gas-tight seal to help prevent process gasses from escaping a corresponding reaction chamber while allowing a rod (e.g., any of the rods discussed above) and/or another suitable component to move through a central opening 2018 of the seal housing 2010 to plunge the corresponding reaction chamber.

As further illustrated in FIGS. 20A and 20B, the sealing device 2000 can also include a scraping component 2030 and a retaining component 2032 at the first end region 2012 of the seal housing 2010. The scraping component 2030 can help scrape carbon (and/or other solid particulates) from the rod (or another suitable component) as it moves through the central opening 2018. Further, the scraping component 2030 is carried by the seal housing 2010 peripheral to the first set of x-profile rings 2040*a* with respect to a center of the seal housing 2010. As a result, the scraping component 2030 can help prevent carbon particulates (and other solids) from reaching the first set of x-profile rings 2040*a* and/or any other component of the sealing device 2000, thereby preventing the carbon particulates (and other solids) from degrading a quality of the sealing device 2000. The retaining component 2032 is positioned peripheral to the scraping component 2030 to help retain the scraping component 2030 in place.

FIGS. 21-29 are schematic cross-sectional views of sealing devices configured in accordance with further embodiments of the present technology. More specifically, FIGS. 21-26 illustrated examples of a scraper component for a sealing device in accordance with further embodiments of the present technology. For example, in the embodiments illustrated in FIG. 21, the sealing device 2100 includes a seal housing 2110, as well as metal brushes 2120 that are attached to the seal housing 2110 via joint components 2122. The joint components 2122 can include one or more springs and/or other suitable flexible joints that allow the metal brushes 2120 to swing upward and downward to scrape a rod 2104 plunging into and out of a reaction chamber 2102.

Figure 22:
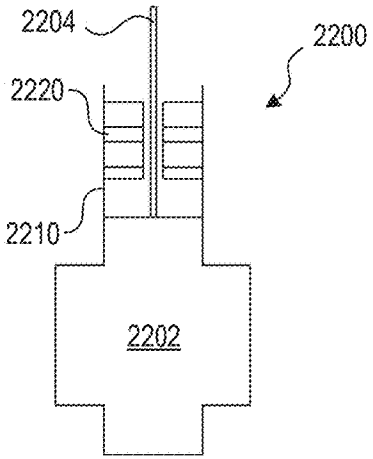

In the embodiments illustrated in FIG. 22, the sealing device 2200 includes a seal housing 2210 that includes a cylindrical array of scraping components 2220. The scraping components 2220 can include various metallic scrapers, scrubbers, and/or abrasive components that are in a fixed location on the seal housing 2210. As a result, the scraping components 2220 can scrape and/or otherwise clean a rod 2204 plunging into and out of a reaction chamber 2202.

Figure 23:
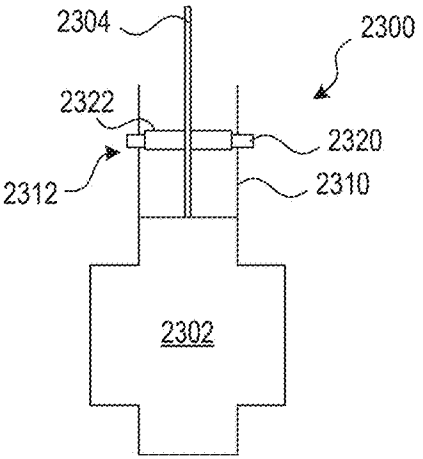

In the embodiments illustrated in FIG. 23, the sealing device 2300 includes a seal housing 2310 that includes slots 2312 that receive spring components 2320 attached to metal scrubbers 2322. The spring components 2320 can apply force to the metal scrubbers 2322 to help ensure they scrape and/or otherwise clean a rod 2304 plunging into and out of a reaction chamber 2302. In the illustrated embodiment, the spring components 2320 are generally orthogonal to the rod 2304. However, it will be understood that the spring components 2320 (as well as the slots 2312 and the metal scrubbers 2322) can be oriented at any other suitable angle with respect to the rod 2304.

Figure 24:
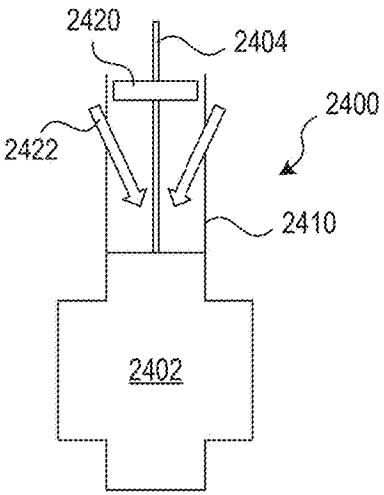

In the embodiments illustrated in FIG. 24, the sealing device 2400 includes a seal housing 2410, a fluid seal 2420, and one or more nozzles 2422 positioned to direct a gas (e.g., pyrolysis fuel, such as methane and/or natural gas) into contact with a rod 2404 and into a reaction chamber 2402. That is, in the embodiments illustrated in FIG. 24, the sealing device 2400 uses the nozzles 2422 to pressurize and clean the rod 2404 with a gaseous flow of the pyrolysis fuel, rather than (or in addition to) a mechanical scraping component.

Figure 25:
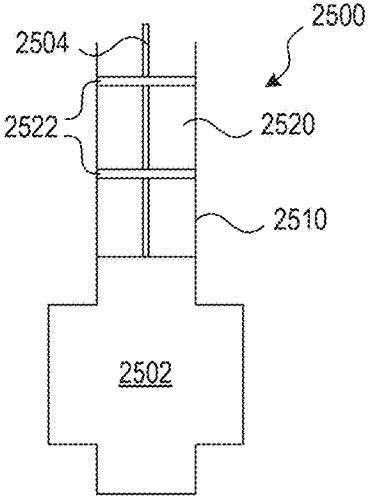

In the embodiments illustrated in FIG. 25, the sealing device 2500 includes a seal housing 2510, as well as an oil chamber 2520 that is book-ended by oil-sealing components 2522. As a rod 2504 passes through the oil chamber 2520, oil in the oil chamber 2520 can remove carbon (and other solids) from the rod 2504 as it moves out of a reaction chamber 2502. In some embodiments, the oil is periodically replaced. In some embodiments, the oil is cycled from the oil chamber 2520 through one or more filters to remove the carbon (and other solids) while reusing the oil.

Figure 26:
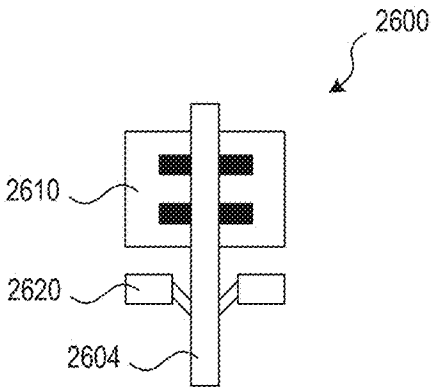

In the embodiments illustrated in FIG. 26, the sealing device 2600 includes a seal housing 2610 and a metal scraper 2620 external to the seal housing 2610 to scrape carbon (and other solids) from a rod 2604 prior to the rod 2604 entering the seal housing 2610. In such embodiments, the metal scraper 2620 can include a material configured to withstand relatively high heat within a reaction chamber. Further, the metal scraper 2620 can absorb heat from the reaction chamber and use the heat to help scrape byproducts (e.g., pyrolysis oils) from the rod 2604 that can otherwise stick to the rod 2604 through other scraping components (e.g., by condensing and sticking to the rod 2604).

Figure 28:
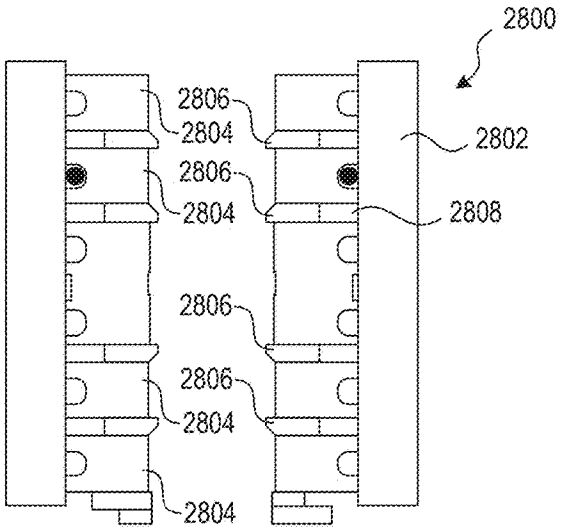
Figure 29:
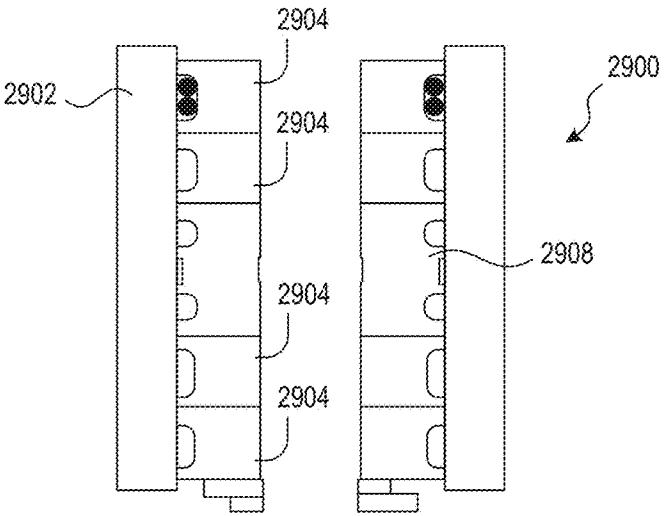
Figure 27:
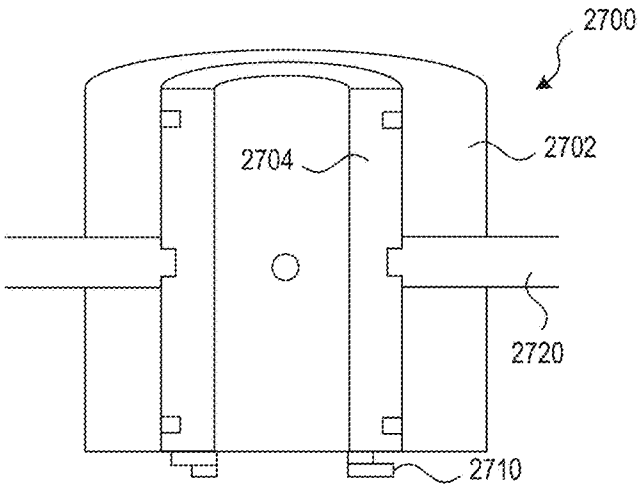

FIGS. 27-29 illustrate examples of full-metal sealing devices in accordance with further embodiments of the present technology. The full-metal construction of the sealing devices in FIGS. 27-29 can provide a higher temperature resistance than polymer and/or rubber seal systems. That is, the full-metal sealing systems can help reduce the chance that the seal system fails or degrades, and/or help relax design constraints on other areas of the system. As a result, the full-metal sealing systems can be used as an alternative or additional seal to the embodiments of the pressurized seal system described above.

In some embodiments, the full-metal sealing system has all-metal contacts between the seal and pushrod. Additionally, or alternatively, the full-metal sealing system can include a scraper at the lower entrance of the seal housing. As a result, the metallic sealing systems can (1) have potentially greater longevity than polymer seals due to lower temperature sensitivity as a result of not having polymers in contact with the rod; (2) reduce the chance that oil leaks out of the sealing system, thereby reducing the chance that oil either contributes to a fire and/or fouls the end effector because oil can be fed in much smaller quantities than with polymer and/or rubber seals; (3) reduce the chance of leaks in the event of a delayed end effector retraction (and therefore a hotter-than-normal rod interacting with the sealing system) since the full-metal seal can resist the heat; and/or (4) help prevent abrasive material from entering the seal housing to reduce or mitigate deleterious effects associated with the wear of the sealing surfaces (e.g., eventually leading to leakage).

In each of the embodiments illustrated in FIGS. 27-29, an inert gas can be introduced between a pair of seals at a pressure greater than the pressure inside a corresponding reaction chamber. As a result, any leakage causes inert gas to leak into the reaction chamber (or into the atmosphere), rather than allowing reaction gases to leak out of the reaction chamber. Further, because small gaps between components of each of the examples in FIGS. 27-29 are unavoidable, an acceptable amount of inert gas leakage is expected. Further, a small and fixed quantity of oil can be introduced to enhance sealing and to lubricate necessary metal-on-metal contact. Still further, on the reaction chamber side of the seals illustrated in FIGS. 27-29, a scraper of any of the types discussed above can help prevent abrasive reaction products (e.g., carbon particulates) from entering the seal housing.

In the embodiments illustrated in FIG. 27, the sealing device 2700 includes a seal housing 2702, a bushing 2704 positioned within the seal housing 2702, and a scraper component 2710 positioned to scrape carbon and other solids from a rod (or other component) external to the seal housing 2702. The bushing 2704 can be sealed to the seal housing 2702 with one or more O-rings. The bushing 2704 can be machined with a relatively small tolerance to the rod that the sealing device 2700 is sealed against. As further illustrated in FIG. 27, the sealing device can include a plurality of flow channels 2720 (two illustrated in FIG. 27) that can introduce inert gas and/or oil to the seal housing to fill and/or block a leakage path due to the tolerance between the bushing 2704 and the rod. In some embodiments, the sealing device 2700 includes a circumferential relief component at a mid-span point. For example, a lantern ring of the type discussed above with reference to FIGS. 19-20B and/or below with reference to FIG. 28 can provide the relief component. A metallic seal according to the embodiments of FIG. 27 can be relatively low cost, but can provide a known leakage point between the bushing 2704 and the rod that consumes oil and/or inert gasses.

In the embodiments illustrated in FIG. 28, the sealing device 2800 includes a seal housing 2802, as well as one or more retaining components 2804 (four illustrated in FIG. 28) and one or more scraping devices 2806 (four illustrated in FIG. 28) carried by the seal housing 2802. The scraping devices 2806 each have a base aperture that is slightly smaller than the rod that the scraping devices 2806 scrapes solids from and/or help forms a seal around. To allow the rod to move through the sealing device 2800, each of scraping devices 2806 can include an elastic material (e.g., a flexible metal) that provides a spring force to expand the aperture. In turn, the spring force can help create a tight seal around the rod. During operation, or at the time of assembly, the scraping devices 2806 can constrict around the rod to help provide a fluid-tight seal. That is, the scraping devices 2806 can act like an inside-out piston ring from an internal combustion engine. In the embodiments illustrated in FIG. 28, the sealing device 2800 includes the scraping devices 2806 at both the top and bottom of the sealing device 2800. It will be understood, however, that the sealing device 2800 can include only a single sealing ring and/or sealing rings at the top or bottom of the sealing device. The retaining components 2804 can help retain the scraping devices 2806 within the seal housing 2802. Additionally, or alternatively, the retaining components 2804 can help reduce leakage around the scraping devices 2806 by providing a tight-fitting land around the scraping devices 2806.

As further illustrated in FIG. 28, the sealing device 2800 can also include a lantern ring 2808 generally at a midpoint of the seal housing 2802. The top and bottom of the lantern ring 2808 can each provide one land surface for a scraping device 2806 and allow lubricating oil and/or inert gas to be introduced to the seal housing 2802. Each of the retaining components 2804 and the lantern ring 2808 can be sealed to the seal housing 2802 via one or more O-rings. A metallic seal according to the embodiments of FIG. 28 is expected to balance the cost of the metallic sealing component against a performance of the seal.

In the embodiments illustrated in FIG. 29, the sealing device 2900 includes a seal housing 2902, as well as a plurality of segmented seals 2904 carried by the seal housing 2902. The segments of the segmented seals 2904 can be pressed tightly against a rod via one or more O-rings and/or pressure from inert gasses provided to the seal housing via a lantern ring 2908. That is, the segments of the segmented seals 2904 can reduce the number of gaps between the segmented seals 2904 and the rod, thereby reducing sources of leaks in the sealing device 2900. Gaps between any of the segments and/or between the segmented seals 2904 can be blocked and/or obscured by oil introduced via the lantern ring 2908. A metallic seal according to the embodiments of FIG. 29 is expected to have a relatively high cost but provide a metallic seal with relatively few leaks via the tight tolerances enabled by the segmented seals 2904.

Figure 30:
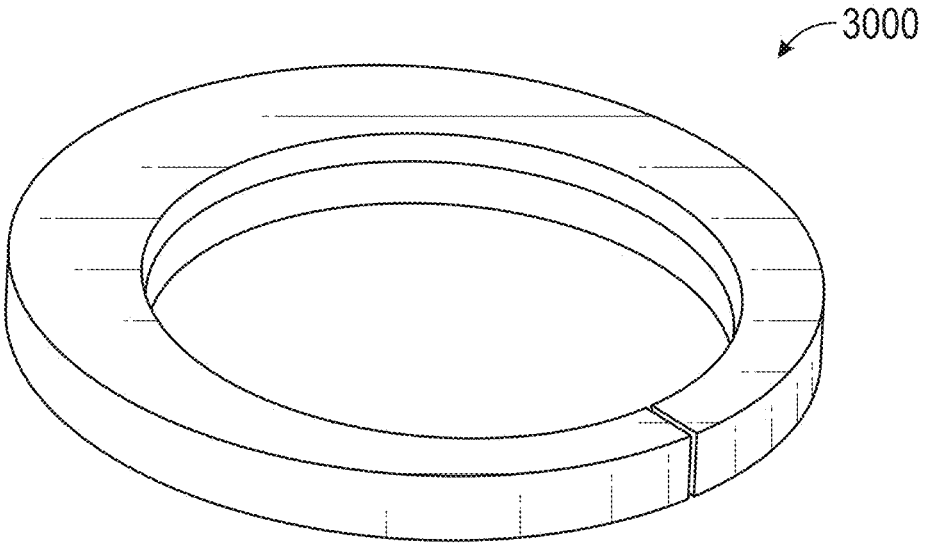
FIG. 30 is a partially schematic isometric view of a sealing component of a sealing device configured in accordance with embodiments of the present technology.

FIG. 30 is a partially schematic isometric views of a tool-scraping device 3000 of a sealing component configured in accordance with embodiments of the present technology. The tool-scraping device 3000 (sometimes also referred to herein as a tool-scraping component) can be generally similar to the scraping devices 2806 discussed above with reference to FIG. 28. For example, the tool-scraping device 3000 illustrated in FIG. 30 can include an elastic material (e.g., a flexible metal) that provides a spring force to an aperture of the tool-scraping device device 3000. In turn, the spring force can help create a tight seal between the sealing component and a rod (or other component) of a carbon removal system. A tool-scraping device 3000 of the type illustrated in FIG. 30 can be implemented with any of the sealing devices discussed herein. Purely by way of example, the tool-scraping device 3000 can be included in the seal component 1950 discussed above with reference to FIG. 19, and/or in any other suitable sealing device.

Figure 31:
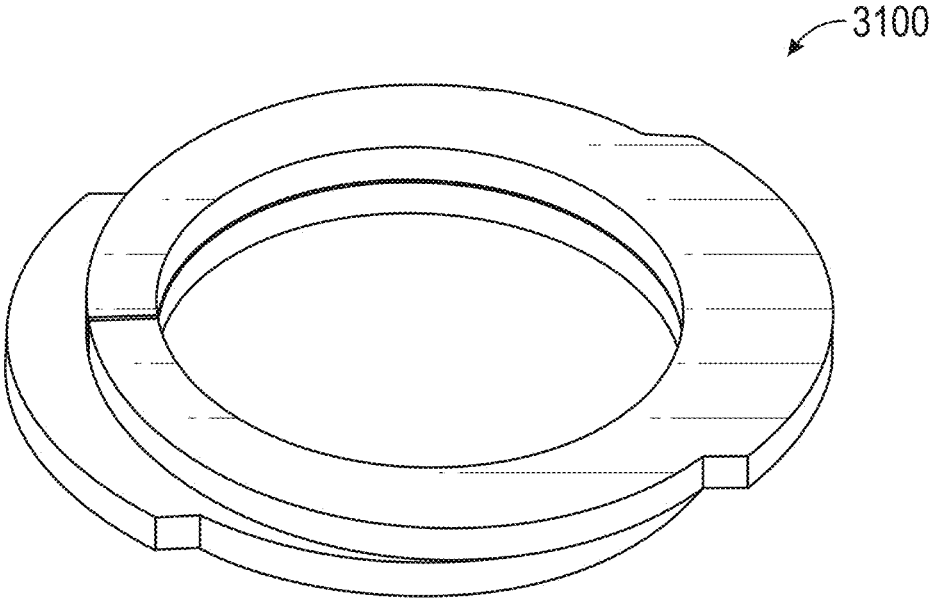
FIG. 31 is a partially schematic isometric view of a tool-scraping component of a sealing device configured in accordance with embodiments of the present technology.

FIG. 31 is a partially schematic isometric view of a tool-scraping component 3100 of a sealing device configured in accordance with embodiments of the present technology. As illustrated in FIG. 31, the tool-scraping component 3100 can be generally similar to the tool-scraping device 3000 discussed above with reference to FIG. 30. For example, the tool-scraping component 3100 can include an elastic material (e.g., a flexible metal) that provides a spring force to an aperture of the tool-scraping component 3100, thereby allowing the tool-scraping component 3100 to tightly scrape the rod (or other component) of a carbon removal system.

In the illustrated embodiment, the tool-scraping component 3100 includes two rings. However, it will be understood that tool-scraping component 3100 can include any other suitable number of rings (e.g., one ring, three rings, five rings, and/or any other suitable number). Further, each of the rings can include features to help prevent rotation of the tool-scraping component 3100. For example, each of the rings can include a tab that can mesh with an insert in the sealing device to help prevent the rings from rotating as the rod is actuated. As further illustrated in FIG. 31, embodiments with multiple rings can be oriented to help improve the scraping function of the rings. For example, the rings can be positioned with their gaps in non-overlapping positions (e.g., on opposite sides of each other) such that no direct path exists for pyrolysis products to pass through the tool-scraping component 3100, even when the rings expand to accommodate a rod.

EXAMPLES

The present technology is illustrated, for example, according to various aspects described below. Various examples of aspects of the present technology are described as numbered examples (1, 2, 3, etc.) for convenience. These are provided as examples and do not limit the present technology. It is noted that any of the dependent examples can be combined in any suitable manner, and placed into a respective independent example. The other examples can be presented in a similar manner.

1. A pyrolysis reactor, comprising:
   - a combustion component fluidly couplable to a combustion fuel supply;
   - a reaction chamber thermally coupled to an output of the combustion component and fluidly couplable to a pyrolysis fuel supply, the reaction chamber configured to transfer heat from the combustion component to a flow of pyrolysis fuel from the pyrolysis fuel supply to generate an output flow comprising hydrogen gas and carbon particulates; and
   - a carbon removal component operably coupled to the reaction chamber, the carbon removal component comprising:
     - an actuator;
     - a rod operably coupled to the actuator and positioned at least partially within the reaction chamber;
     - a sealing device between the rod and the reaction chamber to allow movement of the rod along a longitudinal axis of the reaction chamber and restrict a flow of gas out of the reaction chamber; and a scraper head coupled to the rod, the scraper head having a plurality of teeth positioned to scrape carbon deposits from an interior wall of the reaction chamber during the movement of the rod along the longitudinal axis of the reaction chamber.
2. The pyrolysis reactor of example 1, further comprising a combustion chamber fluidly coupled to the combustion component and positioned to receive a hot flue gas from the combustion component, wherein:

the reaction chamber is positioned circumferentially around the combustion chamber;

the scraper head is a ring-shaped component having an internal side facing the combustion chamber and an external side, wherein the plurality of teeth are positioned along at least one of the internal side or the external side; and the rod is one of a plurality of rods coupled to and distributed about a circumference of the ring-shaped component of the scraper head.

3. The pyrolysis reactor of example 2 wherein:

the scraper head includes a first housing and a second housing rotatably coupled to the first housing, wherein the second housing includes a gear track;

a distal end region of each of the plurality of rods is fixedly coupled to the first housing;

the distal end region of at least one of the plurality of rods includes a gear coupled to the gear track of the second housing; and in operation, driving the gear causes the second housing to rotate about the longitudinal axis with respect to the first housing.

4. The pyrolysis reactor of any of examples 2 and 3 wherein the scraper head includes a first tooth holder coupled to at least some of the plurality of teeth positioned along the internal side and a second tooth holder coupled to at least some of the plurality of teeth positioned along the external side.

5. The pyrolysis reactor of example 1 wherein the combustion component is fluidly coupled to the reaction chamber to direct a hot flue gas through the reaction chamber to transfer the heat from the combustion component to the flow of pyrolysis fuel.

6. The pyrolysis reactor of example 5 wherein:

the scraper head includes a plurality of openings each sized to receive an individual tooth from the plurality of teeth; and the carbon removal component further comprises an end cap couplable to the scraper head to retain each individual tooth within a corresponding opening from the plurality of openings.

7. The pyrolysis reactor of any of examples 5 and 6 wherein:

the rod comprises an internal drive shaft; and the scraper head comprises:

a sun gear coupled to the internal drive shaft of the rod;

a main body having a plurality of openings, each of the plurality of openings sized to receive an individual tooth from the plurality of teeth;

a plurality of gears each coupled to the sun gear and a corresponding tooth from the plurality of teeth, wherein driving the internal drive shaft drives rotation of each of the plurality of gears via the sun gear; and an end cap couplable to the main body to retain each individual tooth within a corresponding opening from the plurality of openings.

8. The pyrolysis reactor of any of examples 1-7 wherein the reaction chamber is one of a plurality of reaction chambers, wherein the carbon removal component includes a plurality of rods and a plurality of scraper heads individually coupled to a corresponding rod from the plurality of rods, and wherein each of the plurality of scraper heads is positioned within a corresponding individual reaction chamber from the plurality of reaction chambers.

9. The pyrolysis reactor of example 8 wherein individual ones of the plurality of teeth has a wedge-shaped profile oriented to at least partially drive a rotation of each of the plurality of scraper heads when the plurality of scraper heads move along the longitudinal axis of the corresponding individual reaction chamber.

10. The pyrolysis reactor of any of examples 1-9 wherein the sealing device comprises one or more expandable components each having an aperture sized to form a seal around the rod.

11. The pyrolysis reactor of any of examples 1-10 wherein the sealing device is fluidly coupled to a pressurized inert gas source.

12. The pyrolysis reactor of any of examples 1-11 wherein the sealing device comprises an elastic scraping component positioned at least partially within the reaction chamber to scrape carbon deposits from the rod during the movement of the rod along a longitudinal axis of the reaction chamber.

13. A solids-removal component for scraping solids (e.g., carbon) from an internal wall of chamber of a reactor (or other system requiring solids removal) during operation of the reactor, the solids-removal component comprising:

an actuator;

a drive component operably coupled to the actuator and positioned at least partially within the chamber of the reactor;

a sealing device coupled to the chamber of the reactor, wherein the sealing device is configured to allow the drive component to move within the chamber and obstruct a flow of gas out of the chamber; and an end effector coupled to the drive component, the end effector having a plurality of scraping components positioned to scrape deposits of the solids from the internal wall of the chamber during movement of the drive component.

14. The solids-removal component of example 13 wherein the chamber is a first chamber of a plurality of chambers in the reactor, wherein the drive component is a first drive component of a plurality of drive components, wherein the end effector is a first end effector of a plurality of end effectors, and wherein the carbon removal component further comprises a strongback coupled between the actuator and the plurality of drive components, the strongback configured to translate motion from the actuator to movement in of each of the plurality of drive components.

15. The solids-removal component of any of examples 13 and 14 wherein the end effector has an annular shape, and wherein the plurality of scraping components comprise an inward-facing subset and an outward-facing subset.

16. The solids-removal component of any of examples 13-15 wherein the movement of the drive component comprises plunges along a longitudinal axis of the chamber of the reactor, and wherein the solids-removal component further comprises an indexing component configured to rotate the drive component about the longitudinal axis between the plunges along the longitudinal axis.

17. The solids-removal component of any of examples 13-16 wherein each of the plurality of scraping components comprises a slot cutter, and wherein two or more of the plurality of scraping components further comprises a wedge cutter coupled to a corresponding slot cutter.

18. The solids-removal component of any of examples 13-17 wherein the movement of the drive component comprises plunges rotation about a longitudinal axis of the chamber of the reactor.

19. A method for continuously operating a reactor (e.g., a pyrolysis reactor), the method comprising:

directing a flow of a hydrocarbon fuel into a chamber of the reactor;

heating the hydrocarbon pyrolysis fuel within the chamber to cause a reaction that creates a product stream, wherein the product stream comprises hydrogen gas and solids (e.g., carbon and/or other solids), and wherein at least a portion of the solids precipitates onto an internal wall of the chamber to form a buildup; and while directing the flow of the hydrocarbon pyrolysis fuel into the chamber, actuating an end effector of a carbon removal component within the chamber to scrape at least a portion of the buildup off of the internal wall.

20 The method of example 19 wherein actuating the end effector comprises moving the end effector along a longitudinal axis of the chamber.

21. The method of example 20, further comprising indexing the end effector between subsequent actuations along the longitudinal axis of the chamber.

22 The method of any of examples 19-21 wherein actuating the end effector comprises rotating the end effector about a longitudinal axis of the chamber.

23 The method of any of examples 19-22 wherein heating the hydrocarbon fuel within the chamber comprises combusting a combustion fuel within the chamber while directing the flow of the hydrocarbon fuel into the chamber.

24. The method any of examples 19-22 wherein the reactor is a pyrolysis reactor, wherein the solid is carbon, wherein the chamber is a reaction chamber at least partially surrounding a combustion chamber of the reactor, and wherein heating the hydrocarbon fuel within the reaction chamber comprises combusting a combustion fuel within the combustion chamber while directing the flow of the hydrocarbon fuel into the reaction chamber.

CONCLUSION

From the foregoing, it will be appreciated that specific embodiments of the technology have been described herein for purposes of illustration, but well-known structures and functions have not been shown or described in detail to avoid unnecessarily obscuring the description of the embodiments of the technology. To the extent any material incorporated herein by reference conflicts with the present disclosure, the present disclosure controls. Where the context permits, singular or plural terms may also include the plural or singular term, respectively. Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Furthermore, as used herein, the phrase "and/or" as in "A and/or B" refers to A alone, B alone, and both A and B. Additionally, the terms "comprising," "including," "having," and "with" are used throughout to mean including at least the recited feature(s) such that any greater number of the same features and/or additional types of other features are not precluded. Further, the terms "generally, "approximately," and "about" are used herein to mean within at least within 10% of a given value or limit. Purely by way of example, an approximate ratio means within 10% of the given ratio.

Several implementations of the disclosed technology are described above in reference to the figures. The computing devices on which the described technology may be implemented can include one or more central processing units, memory, input devices (e.g., keyboard and pointing devices), output devices (e.g., display devices), storage devices (e.g., disk drives), and network devices (e.g., network interfaces). The memory and storage devices are computer-readable storage media that can store instructions that implement at least portions of the described technology. In addition, the data structures and message structures can be stored or transmitted via a data transmission medium, such as a signal on a communications link. Various communications links can be used, such as the Internet, a local area network, a wide area network, or a point-to-point dial-up connection. Thus, computer-readable media can comprise computer-readable storage media (e.g., "non-transitory" media) and computer-readable transmission media.

From the foregoing, it will also be appreciated that various modifications may be made without deviating from the disclosure or the technology. For example, one of ordinary skill in the art will understand that various components of the technology can be further divided into subcomponents, or that various components and functions of the technology may be combined and integrated. In addition, certain aspects of the technology described in the context of particular embodiments may also be combined or eliminated in other embodiments.

Furthermore, although advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

We claim:

1. A system comprising:

a reactor;

a solids-removal component configured to scrape solids from an internal wall of a chamber of the reactor during operation of the reactor, the solids-removal component comprising:

an actuator;

a drive component operably coupled to the actuator and positioned at least partially within the chamber of the reactor;

a sealing device coupled to the chamber of the reactor, wherein the sealing device is configured to allow the drive component to move within the chamber and obstruct a flow of gas out of the chamber;

an end effector coupled to the drive component, the end effector having a plurality of scraping components positioned to scrape deposits of the solids from the internal wall of the chamber during movement of the drive component, wherein the movement of the drive component comprises plunges, of the drive component, along a longitudinal axis of the chamber of the reactor; and an indexing component configured to rotate the drive component about the longitudinal axis between the plunges along the longitudinal axis.

2. The system of claim 1 wherein the end effector has an annular shape, and wherein the plurality of scraping components comprise an inward-facing subset and an outward-facing subset.

3. The system of claim 1 wherein each of the plurality of scraping components comprises a slot cutter, and wherein two or more of the plurality of scraping components further comprises a wedge cutter coupled to a corresponding slot cutter.

4. The system of claim 1 wherein the movement of the drive component further comprises rotation, of the drive component, about a longitudinal axis of the chamber of the reactor.

5. The system of claim 1, wherein the chamber is a first chamber of a plurality of chambers in the reactor, wherein the drive component is a first drive component of a plurality of drive components, wherein the end effector is a first end effector of a plurality of end effectors, and wherein the solids-removal component further comprises a strongback coupled between the actuator and the plurality of drive components, the strongback configured to translate motion from the actuator to movement in each of the plurality of drive components.

6. The system of claim 1, wherein the reactor is a pyrolysis reactor.

7. The system of claim 6, wherein the chamber of the pyrolysis reactor is configured to transfer heat from a combustion component to a flow of pyrolysis fuel to generate an output flow comprising hydrogen gas and carbon particulates.

8. The system of claim 1, wherein the reactor further comprises a combustion chamber, wherein the chamber of the reactor is positioned circumferentially around the combustion chamber.

9. The system of claim 8, wherein:

the end effector has a ring-shaped component having an internal side facing the combustion chamber and an external side, wherein the plurality of scraping components are positioned along at least one of the internal side or the external side; and the drive component is one of a plurality of drive components coupled to and distributed about a circumference of the ring-shaped component of the end effector.

10. The system of claim 9, wherein:

the end effector includes a first housing and a second housing rotatably coupled to the first housing, wherein the second housing includes a gear track;

a distal end region of each of the plurality of drive components is fixedly coupled to the first housing;

the distal end region of at least one of the plurality of drive components includes a gear coupled to the gear track of the second housing; and in operation, driving the gear causes the second housing to rotate about the longitudinal axis with respect to the first housing.

11. The system of claim 9, wherein:

the plurality of scraping components comprise a plurality of teeth; and the end effector includes a first tooth holder coupled to a first at least some of the plurality of teeth that are positioned along the internal side and a second tooth holder coupled to a second at least some of the plurality of teeth that are positioned along the external side.

12. The system of claim 8, wherein:

the end effector includes a plurality of openings to receive an individual scraping component from the plurality of scraping components; and the solids-removal component further comprises an end cap couplable to the end effector to retain each individual scraping component within a corresponding opening from the plurality of openings.

13. The system of claim 8, wherein:

the drive component comprises an internal drive shaft; and the end effector comprises:

a sun gear coupled to the internal drive shaft of the drive component;

a main body having a plurality of openings, each of the plurality of openings sized to receive an individual scraping component from the plurality of scraping components;

a plurality of gears each coupled to the sun gear and a corresponding scraping component from the plurality of scraping components, wherein driving the internal drive shaft drives rotation of each of the plurality of gears via the sun gear; and an end cap couplable to the main body to retain each individual scraping component within a corresponding opening from the plurality of openings.

14. The system of claim 1, wherein the sealing device comprises one or more expandable components each having an aperture sized to form a seal around the drive component.

15. The system of claim 1, wherein the sealing device is fluidly coupled to a pressurized inert gas source.

* * * * *